US011421838B2

(12) United States Patent
Jeong et al.

(10) Patent No.: US 11,421,838 B2
(45) Date of Patent: Aug. 23, 2022

(54) SOLAR-POWERED LIGHTING DEVICES

(71) Applicant: MPOWERD INC., Brooklyn, NY (US)

(72) Inventors: Seungah Jeong, Brooklyn, NY (US); John Salzinger, Brooklyn, NY (US)

(73) Assignee: MPOWERD INC., Brooklyn, NY (US)

( * ) Notice: Subject to any disclaimer, the term of this patent is extended or adjusted under 35 U.S.C. 154(b) by 0 days.

(21) Appl. No.: 16/967,650

(22) PCT Filed: Feb. 5, 2019

(86) PCT No.: PCT/US2019/016660

§ 371 (c)(1),
(2) Date: Aug. 5, 2020

(87) PCT Pub. No.: WO2019/156973

PCT Pub. Date: Aug. 15, 2019

(65) Prior Publication Data

US 2021/0239284 A1 Aug. 5, 2021

Related U.S. Application Data

(60) Provisional application No. 62/660,698, filed on Apr. 20, 2018, provisional application No. 62/626,959, filed on Feb. 6, 2018.

(51) Int. Cl.
*F21S 9/03* (2006.01)
*H05B 45/00* (2022.01)
(Continued)

(52) U.S. Cl.
CPC ..... *F21S 9/032* (2013.01); *F21S 4/10* (2016.01); *F21V 23/06* (2013.01); *H05B 45/00* (2020.01); *F21Y 2115/30* (2016.08)

(58) Field of Classification Search
CPC .. F21S 9/032; F21S 4/10; F21V 23/06; F21Y 2115/30
See application file for complete search history.

(56) References Cited

U.S. PATENT DOCUMENTS 4,984,685 A * 1/1991 Douglas ..... B65H 75/362 206/388
5,720,627 A * 2/1998 Gillbrand ..... H01R 13/72 191/12 R (Continued)

FOREIGN PATENT DOCUMENTS

WO WO 2009/131622 A2 10/2009

OTHER PUBLICATIONS

International Search Report in PCT/US2019/016660 dated Mar. 28, 2019 (2 pages).

*Primary Examiner* — Evan P Dzierzynski
(74) *Attorney, Agent, or Firm* — Bookoff McAndrews, PLLC

(57) ABSTRACT

Solar-powered lighting devices are described, the solar-powered lighting devices including a housing and an electronic cord coupled to the housing. The housing may include a first section coupled to a second section, the first section including a solar panel coupled to an outer surface. The lighting devices may also include a rechargeable battery, a microprocessor, and a user interface to receive user input and transmit the user input to the microprocessor. The electronic cord may be flexible and includes at least one light-emitting diode, wherein the microprocessor is configured to control at least one operating mode of the LED of the electronic cord based on the user input.

20 Claims, 28 Drawing Sheets

(51) Int. Cl.

| | |
|---|---|
| ***F21S 4/10*** | (2016.01) |
| ***F21V 23/06*** | (2006.01) |
| *F21Y 115/30* | (2016.01) |

(56) References Cited

U.S. PATENT DOCUMENTS

| | | | | |
|---|---|---|---|---|
| 8,299,719 | B1 | 10/2012 | Moshirnoroozi | |
| 9,470,413 | B2 | 10/2016 | Li | |
| 2003/0057886 | A1* | 3/2003 | Lys | F21S 4/10 315/291 |
| 2008/0212319 | A1* | 9/2008 | Klipstein | B60Q 3/35 362/231 |
| 2009/0230783 | A1* | 9/2009 | Weed | H02J 7/35 307/150 |
| 2010/0008077 | A1* | 1/2010 | Ponamar | F21S 4/10 362/183 |
| 2016/0107529 | A1* | 4/2016 | Hakeem | B60L 53/14 320/109 |
| 2017/0030535 | A1* | 2/2017 | Han | F21S 4/10 |
| 2017/0311407 | A1* | 10/2017 | Chen | H05B 45/10 |
| 2018/0087764 | A1* | 3/2018 | Davenport | F21V 14/04 |
| 2018/0114958 | A1* | 4/2018 | Lindemann | H01M 50/20 |

* cited by examiner

SOLAR-POWERED LIGHTING DEVICES

CROSS-REFERENCE TO RELATED APPLICATIONS

This application is the U.S. national stage entry under 35 U.S.C. § 371 of PCT/US2019/016660, filed on Feb. 5, 2019, which claims priority to U.S. Provisional Application No. 62/626,959, filed on Feb. 6, 2018, and U.S. Provisional Application No. 62/660,698, filed on Apr. 20, 2018, each of which is incorporated by reference herein in its entirety.

TECHNICAL FIELD

The present disclosure generally relates to solar powered lighting devices. More particularly, the present disclosure include solar-powered lighting devices comprising an electronic cord with one or more lights.

BACKGROUND

Lighting in certain environments may be limited or difficult due to the availability of electricity. While solar power can provide a useful alternative, devices powered by solar energy often are not portable and/or provide one source of light, limited to one area.

SUMMARY

Solar-powered lighting devices and related methods are disclosed herein. According to at least one example, the lighting device comprises a housing including a first section coupled to a second section, the first section including a solar panel coupled to an outer surface of the first section, the lighting device further comprising an electronic cord extending from the housing. For example, the housing may comprise a rechargeable battery operably coupled to the solar panel; a microprocessor operably coupled to the rechargeable battery; and a user interface configured to receive user input and transmit the user input to the microprocessor. The electronic cord may be operably coupled to the rechargeable battery, wherein the electronic cord is flexible and includes at least one light-emitting diode (LED) disposed along a length of the electronic cord, wherein the microprocessor is configured to control at least one operating mode of the LED of the electronic cord based on the user input. According to some aspects of the present disclosure, the microprocessor is configured to control a plurality of operating modes of the lighting device based on the user input, the plurality of operating modes including at least two operating modes of a plurality of LEDs of the electronic cord.

The lighting devices herein may further comprise at least one LED integrated into the housing and configured to emit light outside the housing, optionally wherein the microprocessor is configured control the LED of the housing independent of controlling the LED of the electronic cord. The electronic cord may comprise a plurality of nodes, each node containing at least one LED, e.g., optionally two or more LEDs. In the case of multiple LEDs, the LEDs may face in the same direction or a different direction from each other.

The housing of the lighting device may define a groove for receiving the electronic cord, e.g., in a wrapped configuration. In some examples, the electronic cord comprises braided wire and/or has a length of at least 6 feet, such as 6 feet to 50 feet, or 12 feet to 30 feet, e.g., 18 feet. The housing may have a first, closed configuration and a second, open configuration, the housing being movable between the first and second configurations by moving the first section relative to the second section. The housing may optionally include a third section coupled to the first section, wherein the first and third sections are movable (e.g., rotatable) relative to the second section. Thus, for example, rotating the first and third sections, e.g., as a unit, relative to the second section may move the housing between the first and second configurations for accessing the electronic cord. In at least one example, the first section of the housing is separated from, or coupled to, the second section by a spring. Tension in the spring may bias the first and second sections apart.

The present disclosure also includes a solar-powered lighting device comprising a housing including a first section coupled to a second section, the first section including a solar panel coupled to an outer surface of the first section, the housing further comprising a rechargeable battery operably coupled to the solar panel; a microprocessor operably coupled to the rechargeable battery; a user interface configured to receive user input and transmit the user input to the microprocessor; and a battery indicator operably coupled to the rechargeable battery. The lighting device further comprises an electronic cord coupled to the housing and operably coupled to the rechargeable battery. The electronic cord may be flexible and/or may include a plurality of nodes disposed along a length of the electronic cord, each node containing at least one light-emitting diode (LED). The microprocessor of the lighting device may be configured to control at least one operating mode of the LEDs of the electronic cord based on the user input, e.g., received at the user interface of the housing. Exemplary operating modes include changing an intensity of the LEDs, a wavelength of the LEDs, or both. For example, the at least one operating mode may include at least two operating modes, wherein a first selection of the user interface turns on the LEDs, and second selection of the user interface increases an intensity of the LEDs. Optionally the LEDs may be RGB (multicolor) LEDs, wherein the at least one operating mode includes changing a color of one or more of the LEDs.

The present disclosure also includes a solar-powered lighting device comprising a housing including a first section, a second section, and a third section, the housing being operably coupled to an electronic cord. The first section of the housing may include a solar panel coupled to an outer surface of the first section, and the first and third sections may be movable (e.g., rotatable) relative to the second section. The housing may further comprise a rechargeable battery operably coupled to the solar panel; a microprocessor operably coupled to the rechargeable battery; a user interface configured to receive user input and transmit the user input to the microprocessor; and a battery indicator operably coupled to the rechargeable battery. The electronic cord may be operably coupled to the rechargeable battery, wherein the electronic cord is flexible and includes a plurality of nodes disposed along a length of the electronic cord, each node containing at least one light-emitting diode (LED), wherein the microprocessor is configured to control at least one operating mode of the LEDs of the electronic cord based on the user input.

According to at least one example, the electronic cord comprises a plurality of nodes, and each node contains at least two LEDs that face in different directions. Additionally or alternatively, the housing may defines a groove for receiving the electronic cord, the electronic cord having a length of, e.g., 10 feet to 30 feet. The housing may have a first, closed configuration and a second, open configuration, the housing being movable between the first and second configurations by moving the first section relative to the second section. Optionally, an end of the electronic cord includes an electronic connector compatible with an external electronic device, or a clip, hook, or other attachment.

Any of the exemplary devices herein (including the examples above) may include more than one electronic cord, e.g., two, three, or more electronic cords. Such electronic cord(s) may be fixedly attached to the housing, e.g., fixed to an interior component of the lighting device, or may be detachable from the housing, e.g., via an electronic connector. For example, the electronic cord(s) may be mounted to an electronic component, such as a printed circuit board (PCB) assembly, or may be operably coupled to such electronic component via an electronic connector. Further, any of the exemplary devices herein (including the examples above) may include a handle or other type of support element, e.g., to facilitate hanging the device from a structure and/or to facilitate standing the device on a floor, table top, or other structure.

BRIEF DESCRIPTION OF THE FIGURES

The accompanying drawings, which are incorporated in and constitute a part of this specification, illustrate various exemplary embodiments and together with the description, serve to explain the principles of the disclosed embodiments.

FIGS. 11A-11C show an exemplary device in accordance with some aspects of the present disclosure, wherein FIG. 1A shows a perspective view, FIG. 11B shows an exploded view, and FIG. 11C shows a side view of a housing component of the device.

FIGS. 12A-12D show exemplary modular configurations of devices in accordance with some aspects of the present disclosure, wherein FIG. 12A shows two devices coupled together in a linear configuration, FIG. 12B shows an exploded view of a device of FIG. 12A, and FIGS. 12C and 12D show devices in a stacked configuration.

FIGS. 13A-13D show an exemplary device in accordance with some aspects of the present disclosure, wherein FIG. 13A shows an exploded view, FIGS. 13B and 13C show perspective views, and FIG. 13D shows a cross sectional side view.

FIGS. 14A-14D show an exemplary device in accordance with some aspects of the present disclosure, wherein FIG. 14A shows a perspective view, FIG. 14B shows an exploded view, FIG. 14C shows a top view of a base of the device, and FIG. 14D shows a cross sectional side view of the device.

FIGS. 15A-15D show an exemplary device in accordance with some aspects of the present disclosure, wherein FIG. 15A shows an exploded view, FIG. 15B shows a perspective view, FIG. 15C shows a top view of a base of the device, and FIG. 15D shows a cross sectional side view of the device.

DETAILED DESCRIPTION

Embodiments of the present disclosure include portable, solar-powered lighting devices that include one or more light sources that may be arranged in different configurations. For example, light sources of the devices herein may be coupled together via a cord, e.g., allowing for the lighting devices to be arranged in different configurations and/or the light sources to be hung from various structures, similar to string lights. The lighting devices herein may include a housing that includes at least one solar panel arranged on an exterior-facing surface, the solar panel(s) being operably coupled to a power source, e.g., one or more rechargeable batteries. The devices herein may be suitable for indoor and/or outdoor use.

Figure 1:
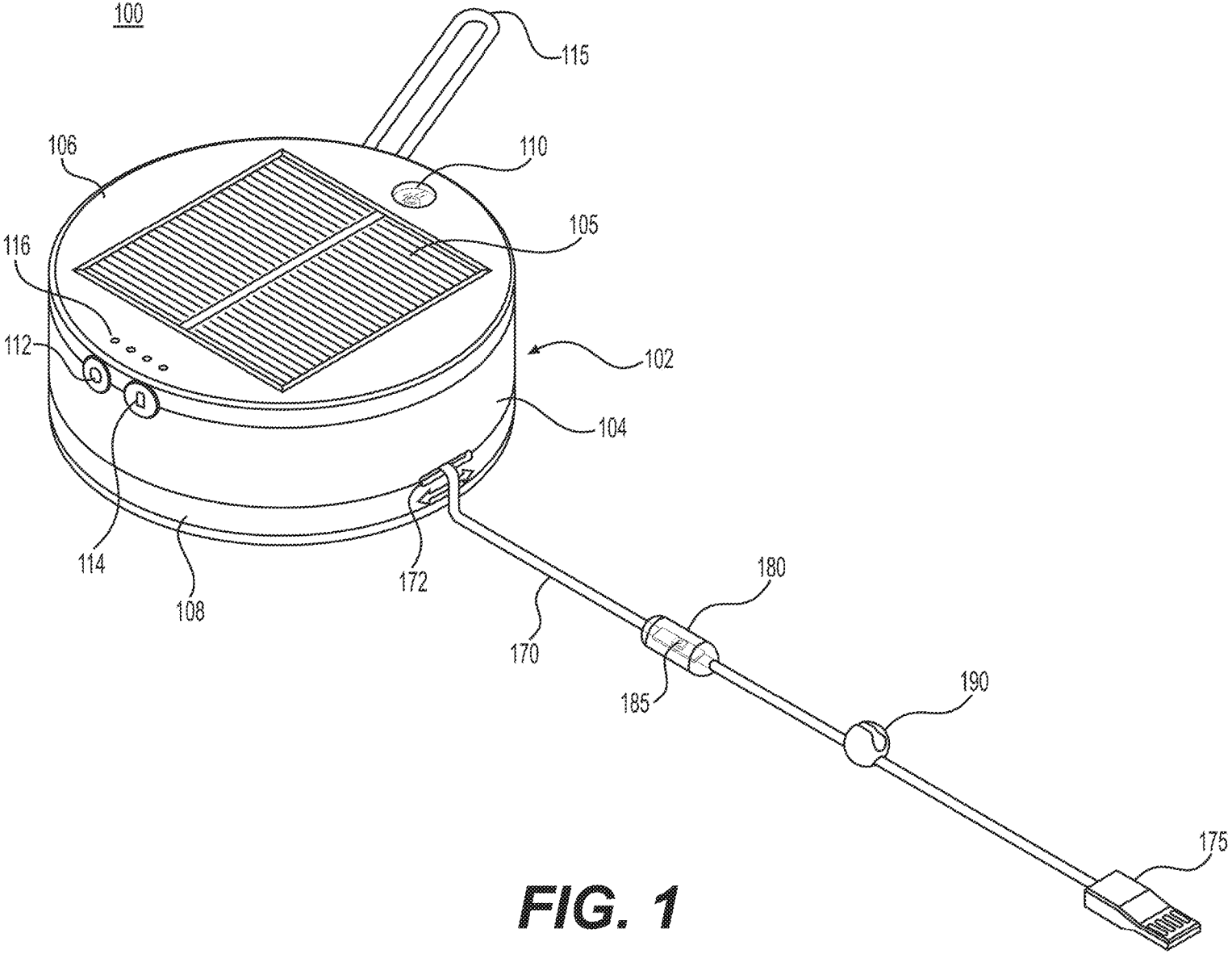
FIG. 1 shows a perspective view of an exemplary lighting device, in accordance with some aspects of the present disclosure.

An exemplary lighting device 100 is illustrated in FIGS. 1-5. As shown in FIG. 1, the lighting device 100 includes a housing 102 and a cord 170 coupled thereto, the cord 170 including at least one node 180 containing one or more light sources 185, such as a light emitting diode (LED). The housing 102 may be movable between a first, closed configuration and a second, open configuration to allow a user to access the cord 170 stored within the housing 102, as further described below.

As shown, the housing 102 includes a first (upper) section 106, a second (lower) section 108, and a third section 104 therebetween forming one or more side walls between the first and second sections 106, 108. In some exemplary devices, the housing 102 may be cylindrical in shape, as illustrated in FIG. 1, wherein the first section 106 and the second section 108 of the housing 102 are each circular in cross-section and form upper and lower walls of the housing 102, and the third part 104 forms a substantially vertical side wall. The housing 102 may have any other suitable shape, e.g., the first, second, and/or third sections 106, 108, 104 having cross-sectional shapes such as square, rectangular, triangular, etc. For example, the housing 102 may have a generally spherical or polyhedral shape (e.g., cube, pyramid, rectangle, star, etc.). The different sections 106, 108, 104 may be coupled together via any suitable mating elements including, e.g., friction fit, clips, screws, threads, magnets, adhesive, thermal sealing, etc. One or more portions of the housing may be dust and/or water resistant.

Each component of the housing, e.g., sections 106, 108, 104 may comprise a polymer, e.g., a thermoplastic polymer such as acrylonitrile butadiene styrene (ABS), thermoplastic polyurethane (TPU) or other thermoplastic elastomer (TPE), or combinations thereof. In some examples herein, the housing 102 may include one or more designs or markings. For example, the housing 102 may bear a design, such as a logo, integrated with, painted on, attached to, embossed from, or engraved in the material of the housing 102.

With reference again to FIG. 1, the lighting device 100 may include a handle 115 or other support member, e.g., that a user can grasp when carrying the lighting device 100 or from which the lighting device 100 may be hung. For example, the handle 115 may be used to hang the lighting device 100 from a hook, a tree branch, or other structure. In some examples, the handle 115 may be attached to a clip such as a carabiner for hanging. The handle 115 may be flexible (e.g., comprising a pliable polymer, a braided cord, or a fiber material such as nylon) or rigid (e.g., comprising a rigid or semi-rigid polymer, a metal, or a metal alloy). Exemplary materials suitable for the handle include, but are not limited to, silicone, ABS, thermoplastic polyurethane (TPU), polyethylene (PE), polyvinylchloride (PVC), among other types of polymers and materials.

Figure 2:
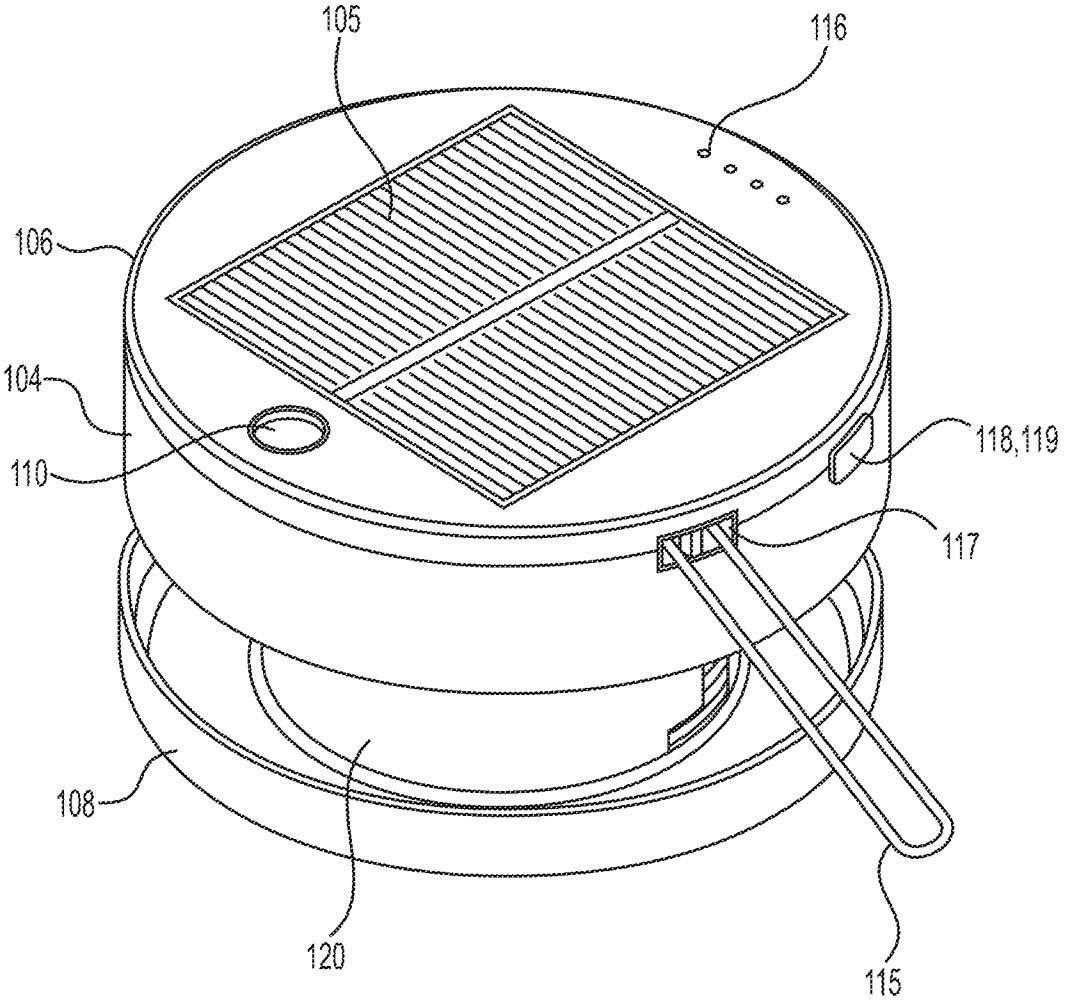
FIG. 2 shows a second perspective view of the device of FIG. 1.
Figure 8B:
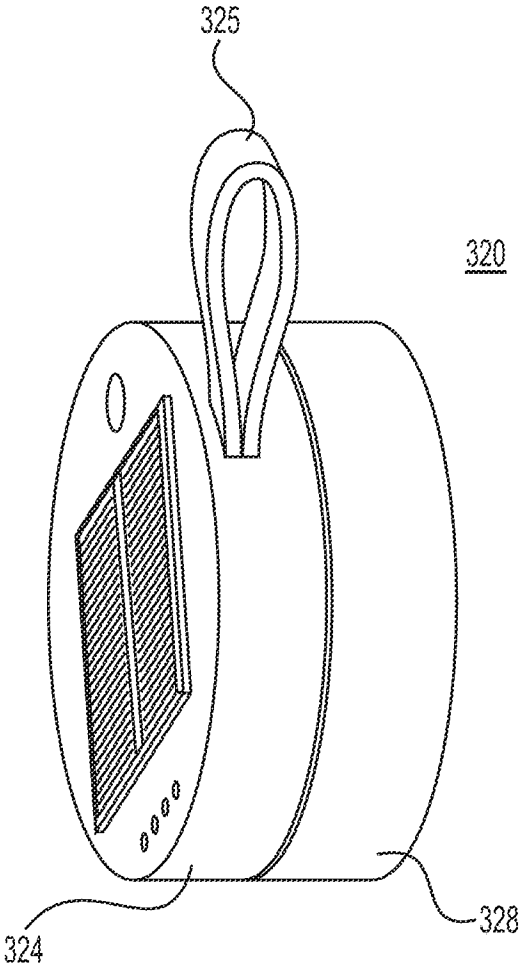
FIGS. 8A-8C show exemplary devices in different configurations, in accordance with some aspects of the present disclosure.
Figure 8A:
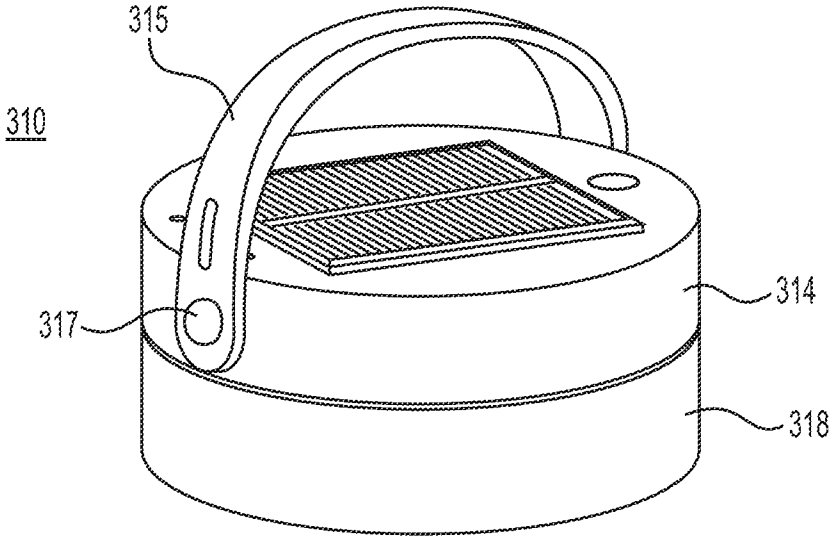
Figure 8C:
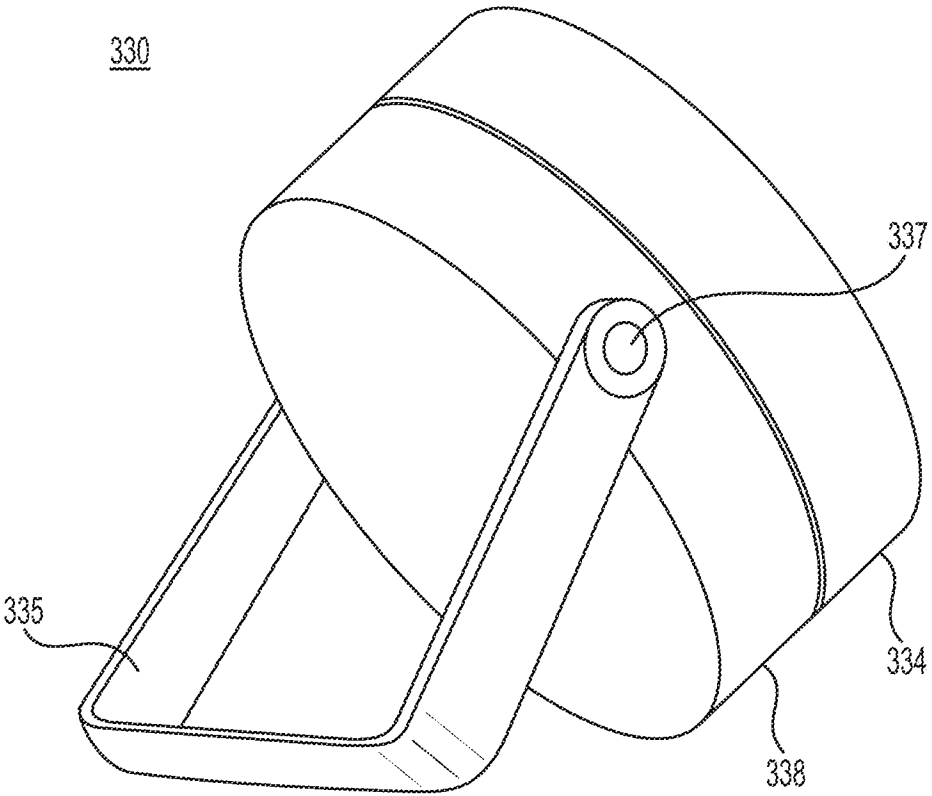

The handle 115 may be permanently attached to the housing 102. For example, as shown in FIG. 2, ends of the handle 115 are fixed to an inner portion of the housing 102 with the body of the handle 115 extending through a slot 117 of the housing 102. In some aspects of the present disclosure, the handle 115 may be detachable from the housing 102, e.g., via complementary mating elements (clips, screws, magnets, Velcro, etc.). Other types of handles and support members that may be used with the lighting device 100 are illustrated in FIGS. 8A-8C.

Further referring to FIG. 1, the lighting device 100 includes at least one solar panel 105 coupled to, or otherwise integrated into, one or more portions of the housing 102, such as the outer surface of the first section 106, with the solar panel 105 facing outward. The first section 106 may include an aperture (see FIG. 3) complementary to the shape of the solar panel 105, wherein the outer surface of the solar panel 105 may be flush with the outer surface of the first section 106. In some examples of the present disclosure, the outer surface of the first section 106 includes a recessed portion complementary to the shape of the solar panel 105. The depth of the recessed portion may be selected such that surface of the solar panel 105 is flush with the surface of the first section 106. The recessed portion may include an opening to allow for an electrical connection between the solar panel 105 and other components of the lighting device 100 contained within the housing 102.

The solar panel 105 may comprise any suitable materials for generating electricity. For example, the solar panel 105 may comprise silicon, e.g., monocrystalline or polycrystalline silicon. The solar panel 105 may be coupled to a support material, such as polycarbonate or other plastic or polymer. In some examples, the solar panel 105 is mounted to a circuit board (see FIG. 3). The solar panel 105 may produce a voltage ranging from about 4V to about 8V, e.g., about 5V, about 6V, or about 7V. These voltages are only exemplary, and other voltages are contemplated by the disclosure herein. The solar panel may comprise one or more solar cells, e.g., one or more arrays of solar cells. In some examples, the solar component may include two or more solar panels 105.

The surface of the solar panel 105 may be at least partially covered by a material for protection, wherein the material allows sunlight to pass therethrough for generating electricity. For example, the solar panel(s) 105 may be covered by a transparent film that allows natural and/or artificial light to pass therethrough to be received by the solar panel 105. For example, the solar panel 105 may be covered by a transparent or substantially transparent polymer (e.g., plastic) material, such as clear polyvinyl chloride (PVC). The cover may be integrated with housing 102, such that the film is flush with the surface of the first wall 106.

The lighting device 100 may comprise one or more rechargeable batteries 140 operably coupled to the solar panel 105 in order to store electricity generated by the solar panel 105. Exemplary batteries 140 useful for the devices herein include, but are not limited to, lithium-ion batteries, including lithium-ion polymer and lithium nickel manganese cobalt oxide (NMC). Each rechargeable battery 140 may generate a voltage from about 2V to about 5V, such as from about 3V to about 4V, e.g., a voltage of about 3.2V, about 3.5V, about 3.7V, or about 4.0V. Each battery 140 may have a capacity of about 500 mAh to about 2500 mAh, e.g., a capacity up to at least 2000 mAh. For example, the each battery 140 may have a capacity of about 500 mAh, about 750 mAh, about 1000 mAh, about 1250 mAh, about 1500 mAh, about 1750 mAh, or about 2000 mAh. The battery 140 may have a capacity up to at least 2000 mAh, such as a capacity of about 500 mAh, about 750 mAh, about 1000 mAh, about 1250 mAh, about 1500 mAh, about 1750 mAh, about 2000 mAh, about 2250 mAh, or about 2500 mAh. For example, the capacity of the battery 140 may be sufficient to charge an external electronic device such as a mobile phone or tablet device. In at least one example, the lighting device 100 comprises at least one 2000 mAh or 2500 mAh battery, such as a 200 mAh 3.7V lithium ion polymer battery In at least one example, the lighting device 100 comprises two 2500 mAh batteries, forming a 5000 mAh power cell.

The rechargeable battery 140 may provide sufficient power for illuminating LEDs of the lighting device for at least 12 hours, at least 15 hours, or at least 20 hours on a low setting (15 lumens), e.g., from 6 hours to 24 hours, or from 16 hours to 20 hours. The solar panel 105 may allow for recharging the battery 140 in less than 24 hours in direct sunlight, such as less than 18 hours, less than 14 hours, less than 12 hours, or less than 8 hours, e.g., from 6 hours to 18 hours, or from 12 hours to 14 hours in direct sunlight.

Figure 3:
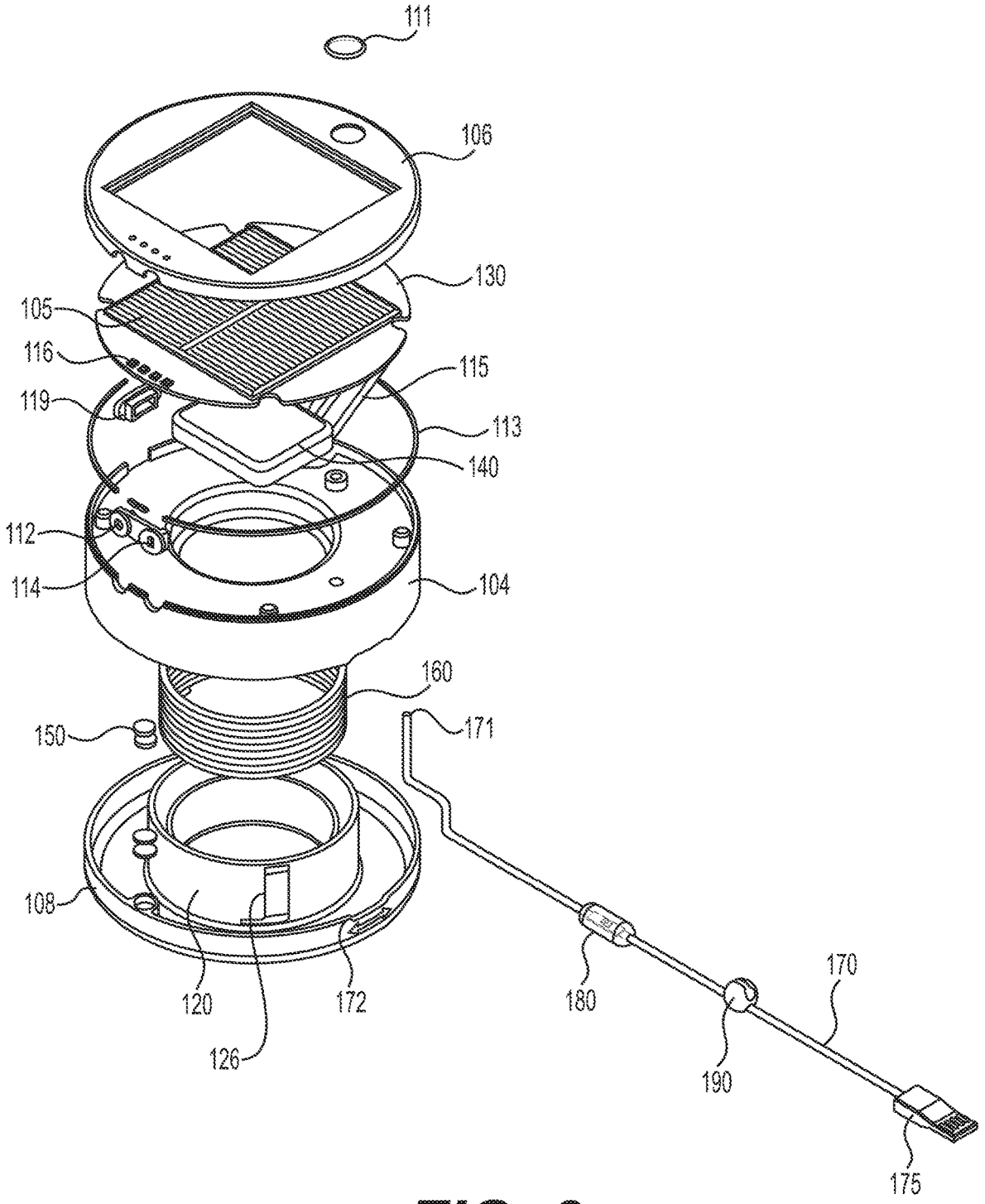
FIG. 3 shows an exploded view of the device of FIG. 1.
Figure 4:
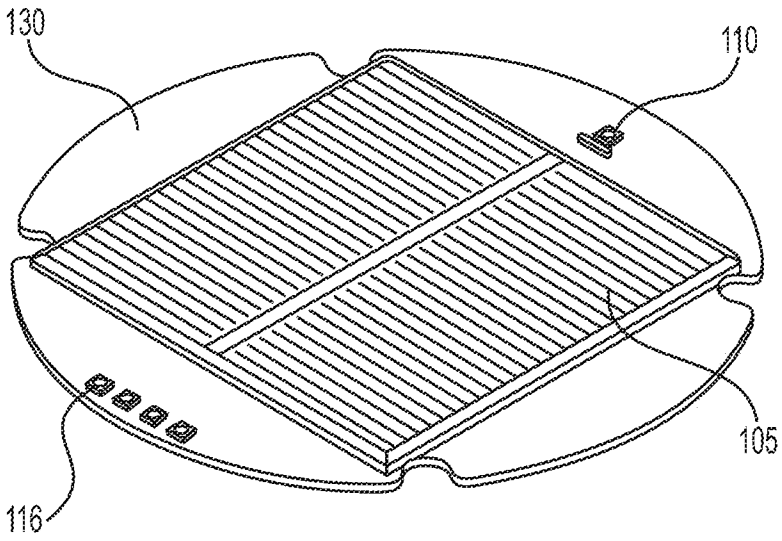
FIG. 4 shows an exemplary electronics assembly, in accordance with some aspects of the present disclosure.

Two or more electronic components may be coupled together in an electronics assembly, e.g., via a circuit board, such as a printed circuit board (PCB). For example, the lighting device 100 may include a PCB assembly 130 that includes or is otherwise operably coupled to one or more solar panels, rechargeable batteries, light sources, processors/microprocessors, transceivers, current regulators, and/or electronic connectors. FIG. 3 illustrates an example wherein the battery 140 is in communication with, but not mounted to, the PCB assembly 130. As shown, housing 102 defines a cavity, e.g., a central cavity in the third section 104, below the PCB assembly 130, for receiving the battery 140. In other examples, the rechargeable battery 140 may be mounted to the PCB assembly 130, e.g., on the same surface or a different surface than other components such as the solar panel 105. FIG. 4 shows the solar panel 105 mounted to the PCB assembly 130.

The lighting device 100 also includes at least one base light 110 and a plurality of indicator lights 116 mounted to the PCB assembly 130 (see FIG. 4). Each of the base light 110 and the indicator lights 116 may be a one-color (white) LED or an RGB (multi-color) LED. The base light 110 is coupled to a user interface 112, such as a power button or switch, to allow a user to control the base light 110. While one base light 110 is shown, the lighting device 100 may include two or more base lights 110 oriented in the same direction or different directions. For example, one or more base lights 110 may emit light in a direction perpendicular or otherwise transverse to the PCB assembly 130 and/or one or more base lights 110 may emit light in a direction parallel to the PCB assembly 130 (see, e.g., FIG. 9). Each base light 110 may have a light output ranging from about 10 lumens to about 100 lumens, for example. In some examples, one or more base lights 110 may have a bright intensity setting, e.g., useful as a flashlight. For example, the base light(s) 110 may have a light output of 100 lumens or greater, e.g., 120 lumens or greater, or 150 lumens or greater.

The indicator lights 116 are coupled to a battery indicator 114 (which also may be in the form of a button or switch), which when selected by a user, provides information regarding the amount of power remaining in the lighting device 100. That is, selecting the battery indicator 114 may cause all of the indicator lights 116 to illuminate in the case of a fully charged battery 140, some of the indicator lights 116 in the case of a partially charged battery 140, and none of the indicator lights 116 in the case of a battery 140 without charge.

The user interface 112 and battery indicator 114 may be integrated into a portion of the housing 102 such as the first section 106, the second section 108, the third section 106, or between the first and third sections 106, 104 (as shown in FIG. 1). Further, the user interface 112 and battery indicator 114 each may be operatively coupled to the PCB assembly 130 in order to transmit user input to the appropriate electronic component(s).

In addition to controlling the base light 110, the user interface 112 may be used to control different operating modes of other light sources (e.g., light sources 185 of cord 170). For example, the PCB assembly 130 may include one or more microprocessors configured to control different operating modes of the lighting device 100, described below. In some examples, the PCB assembly 130 may include a transceiver configured to receive data from an external electronic device, such as, e.g., a mobile device, for initiating or altering different operating modes. The transceiver may communicate with the external electronic device using Near Field Communication (NFC), Bluetooth, WiFi, or infrared signals.

The lighting device 100 may include one or more electronic connectors to allow for transfer of power between the lighting device 100 and an external electronic device. Exemplary electronic connectors include, but are not limited to, universal serial bus (USB) and USB-like connectors (USB-A, USB-B, USB-C, micro-USB, etc.), Thunderbolt connectors, and Lightning connectors (e.g., for electronic devices manufactured by Apple Inc.). Each electronic connector may be a male or female connector.

In some examples, the housing 102 may include one or more electronic connectors 118. As mentioned above, the rechargeable battery 140 may have sufficient capacity to charge an external electronic device such as a mobile phone or tablet device, among other types of electronic devices. Similarly, the electronic connector 118 may be used to charge the battery 140 from an external power source. For example, the electronic connector 118 may recharge the battery 140 in less than 12 hours, less than 8 hours, or less than 6 hours, e.g., from 2 to 10 hours, or 6 to 8 hours. While the lighting device 100 is shown with one electronic connector 118, the devices herein may include a plurality of electronic connectors, e.g., two or more electronic connectors (see, e.g., discussion below regarding electronic connector 175 of lighting device 100, and the device features shown in FIGS. 11A and 13A). The electronic connector(s) 118 optionally may be protected by a cover 119, e.g., a rubber or urethane cover, when not in use.

According to some aspects of the present disclosure, the lighting device 100 may further include one or more sensors, e.g., coupled to the PCB assembly 130. The sensors may be configured to detect environmental conditions such as the presence or absence of ambient light, the amount of ambient light, the time of day, and/or ambient temperature. The sensor(s) may communicate with the PCB assembly 130 in order to initiate or change an operating mode of the lighting device 100, e.g., via instructions programmed in a microprocessor.

Figure 14A:
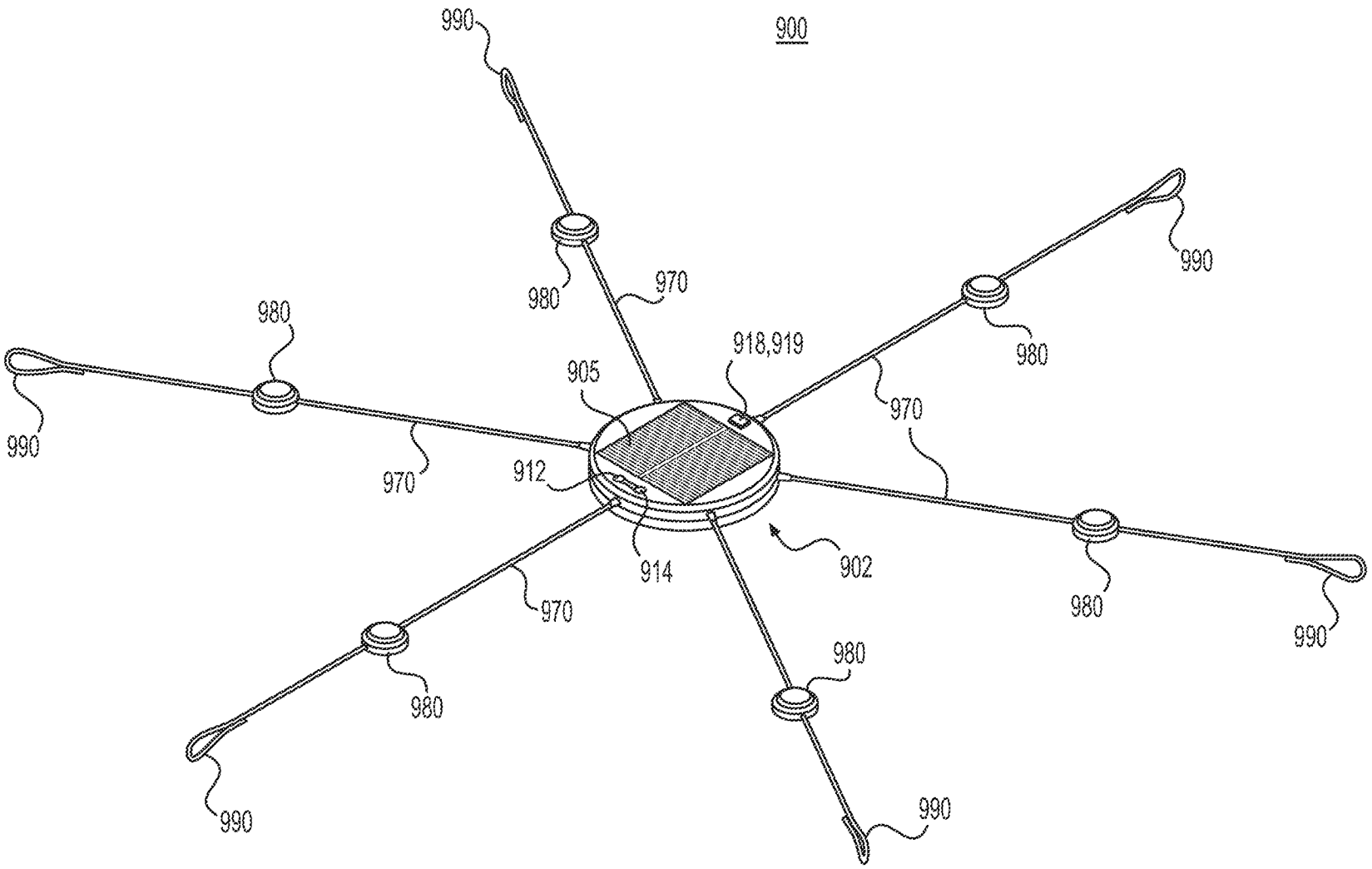
Figure 14B:
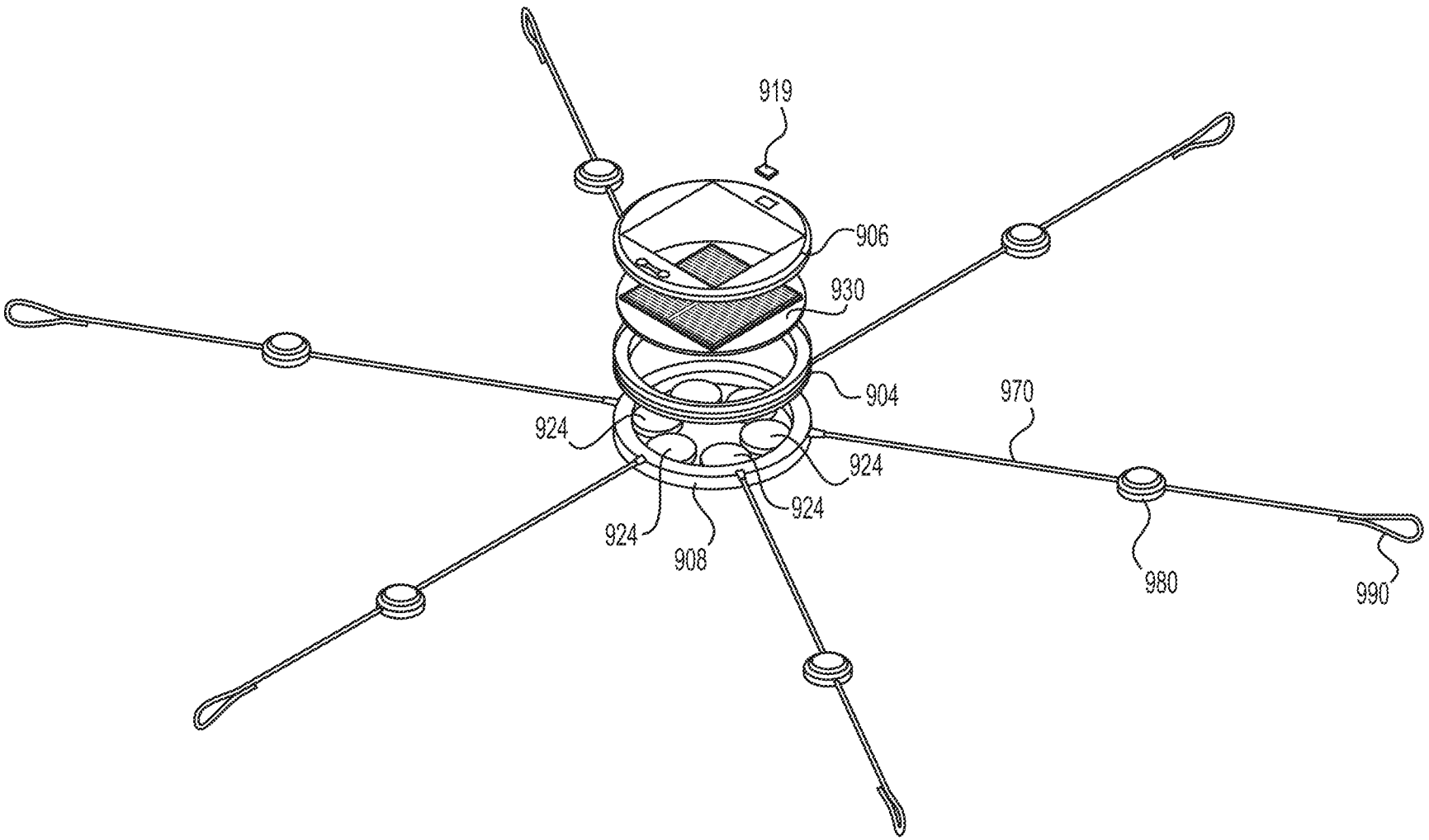

As mentioned above, the lighting device 100 includes a cord 170, e.g., an electronic cable or wire, coupled to the housing 102. In some examples, the cord 170 includes braided wire. The cord 170 optionally may include an outer covering, such as a polymeric or fabric sheath. While only one cord 170 is shown in the example of FIG. 1, the devices herein may include two or more cords 170 (see, e.g., FIGS. 14A-14B). The cord 170 may be flexible to allow for wrapping the cord 170 around the housing 102 for storage, as described below, and to allow a user to hang the cord 170 in and around structures in the manner of string lights.

The cord 170 includes at least one node 180, wherein each node contains at least one light source 185, such as an LED. In some examples, the cord 170 includes a plurality of nodes 180 arranged along the length of the cord 170, e.g., at regular intervals. The cord 170 optionally may include one or more clips 190 to assist with securing the cord 170 for storage.

According to some aspects of the present disclosure, the cord 170 may be 1 foot to 30 feet or more in length, e.g., 2-20 feet, 5-10 feet, 15-30 feet, e.g., 12 feet, 15 feet, 18 feet, 20 feet, 22 feet, 25 feet, 28 feet, or 30 feet. Further, for example, the cord 170 may include two or more nodes 180, e.g., 3, 4, 5, 6, 7, 8, 9, 10, 11, 12, 13, 14, 15, 20, 25, 30, 40, or 50 or more nodes, disposed along the length of the cord 170. Each node 180 may include one, two, or three of more LEDs 185. Thus, for example, the cord 170 may include from one LED 185 (in cases of one node 180 with one LED 185) to 150 or more LEDs 185 (in cases of three or more LEDs per node). In some examples, the cord 170 includes 5 to 50 LEDs, such as 10 to 30 LEDs, 20 to 25 LEDs, 40 to 50 LEDs, or 25 to 35 LEDs. When the node 180 contains more than one LED, the LEDs may face in the same direction or different directions. For example, the node 180 may contain two LEDs 185 facing in opposite directions, away from the cord 170.

Each node 180 may include a housing that comprises a transparent or translucent material allowing light generated by the LEDs 185 to pass therethrough. The material may be clear or colored and/or the housing may be frosted or have a texture to allow for diffusion of light. Exemplary materials for the housing include, but are not limited to, rigid polymers such as ABS. The node 180 may have any suitable shape, including, for example, ellipsoidal, e.g., pill shaped, spherical, cylindrical, conical, trapezoidal, cuboidal, or other polygonal shapes. The housing of each node 180 may be a single piece or may be formed from two or more pieces coupled together.

Figure 6:
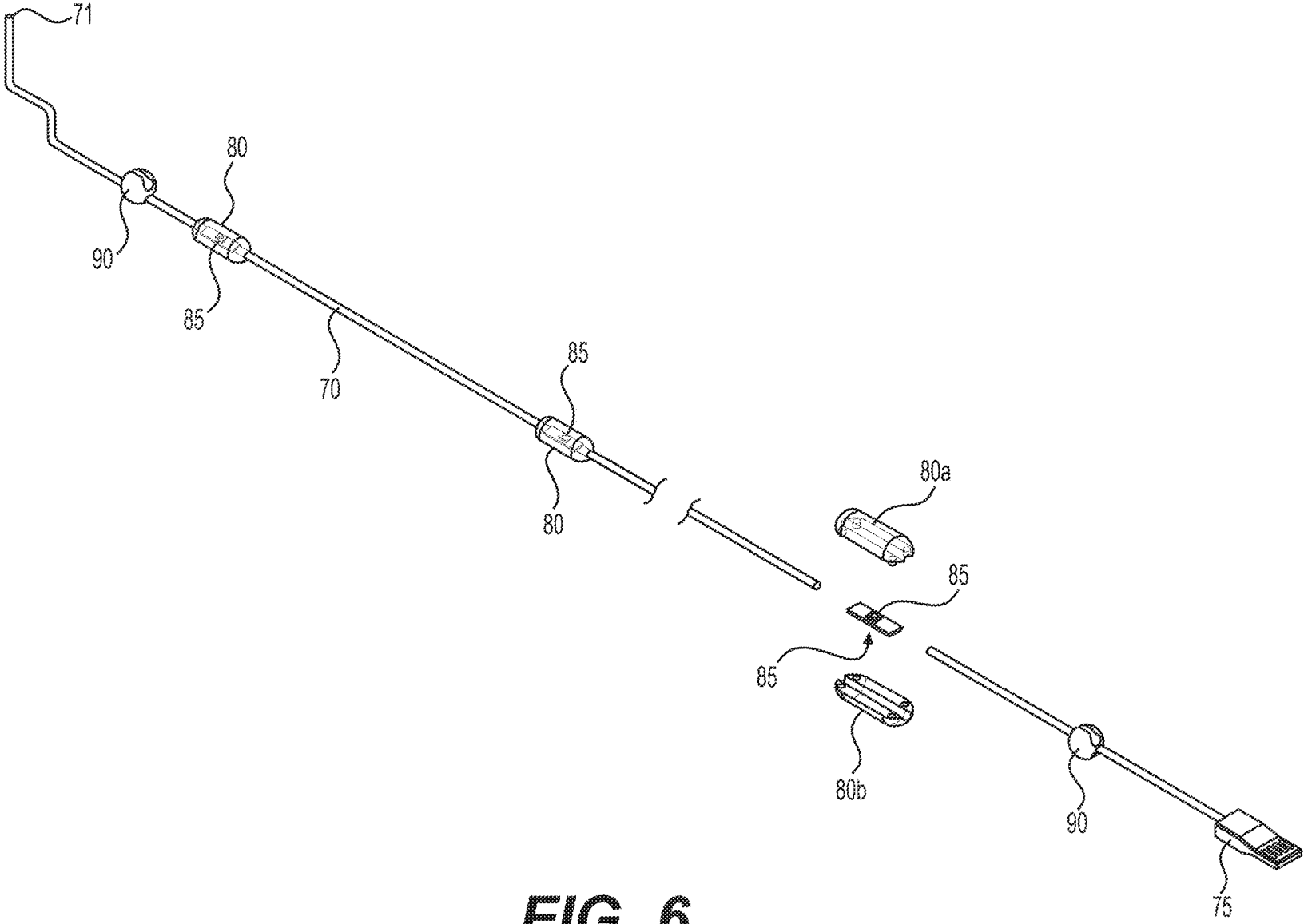
FIG. 6 shows an exemplary lighting component, in accordance with some aspects of the present disclosure.
Figure 7A:
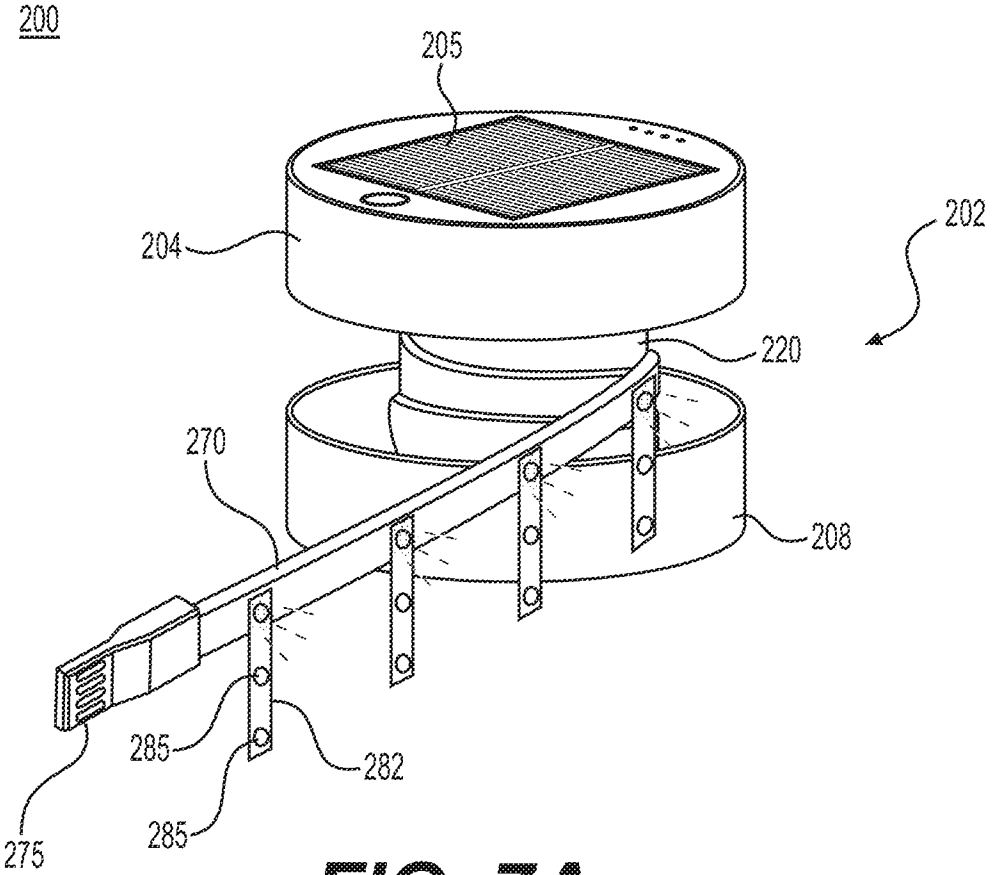
FIGS. 7A and 7B show additional exemplary devices, in accordance with some aspects of the present disclosure.
Figure 7B:
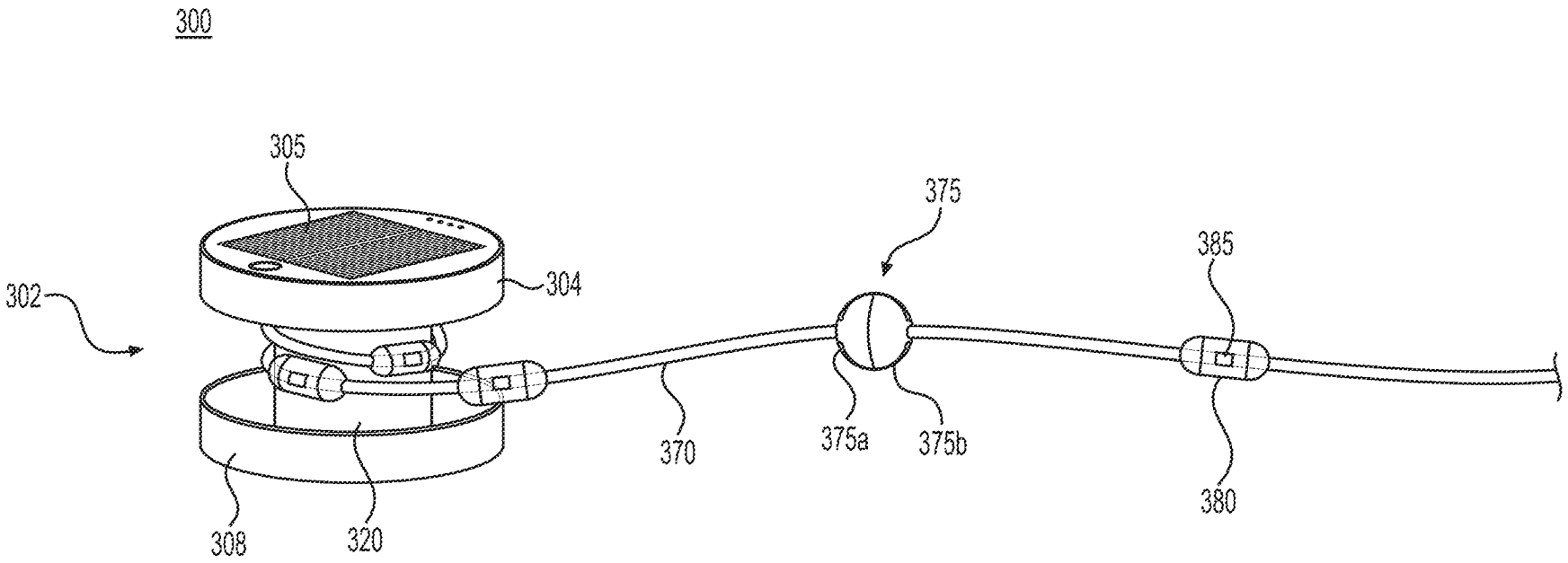

Reference is also made to FIG. 6, showing another exemplary cord 70 that may be used in lighting device 100 and/or other devices encompassed herein. As shown, the cord 70 includes a plurality of nodes 80, wherein each node includes a housing formed from two pieces 80*a*, 80*b*, coupled together. For example, the housing pieces 80*a*, 80*b* may be attached together with an adhesive, or may fit together with any suitable mating elements, such as clips or by friction fit. Each node 80 contains two LEDs 85 facing in opposite directions, i.e., one LED facing housing piece 80*a*, and the other LED 85 facing housing piece 85*b*. In other examples, each node may contain four LEDs 85, two LEDs 85 adjacent to each other along the cord 70 that face housing piece 80*a*, and two LEDs adjacent to each other along the cord 70 that face housing piece 80*b*. FIG. 6 also illustrates an example with two clips 90, each clip 90 defining a groove complementary to the size and shape of the cord 70. Thus, for example, the clips 90 may be used to secure the cord 70 for storage when the cord 70 is wrapped around the housing of a lighting device. Additionally exemplary cords that may be used with the lighting device 100 and/or other devices herein are illustrated in FIGS. 7A and 7B, discussed below.

Referring again to FIG. 1, the LEDs 185 (or LEDs 85 of FIG. 6) may have a light output ranging from 10 lumens to 100 lumens, such as, e.g., from about 15 lumens to about 85 lumens, from about 25 lumens to about 75 lumens, from about 35 lumens to about 65 lumens, or from about 45 lumens to about 55 lumens. For example, the light(s) may have a light output of 10, 15, 20, 25, 30, 35, 40, 45 50, 55, 60, 65, 70, or 75 lumens. Each LED may be a one-color (white) LED or an RGB (multi-color) LED. For example, RGB LEDs may be configured to emit different colors of visible light (e.g., red, orange, pink, yellow, green, blue, violet/purple, white, and/or combinations thereof, such as magenta, cyan, amber, etc.). In some examples, one or more LEDs 85 may be configured to change color based on an operating mode of the lighting device 100. In further examples, the light(s) may be configured to emit infrared light, and/or ultraviolet light, such as UV-A (blacklight), UV-B, and/or UV-C. Further, depending on the operating mode(s) of the lighting device 100, the LEDs may be configured to change intensity gradually (e.g., to higher or lower intensity) and/or immediately (e.g., flashing on/off).

In some examples, a first end 171 of the cord 170 may be fixedly attached to an interior portion of the housing 102, wherein the housing 102 includes a slot 172 (between the third section 104 and the second section 108) through which the cord 170 extends. The cord 170 is operably coupled to the rechargeable battery 140 and the solar panel 105, such that power stored within the battery 140 can be used to power the light sources 185. For example, the first end 171 of the cord 170 (see FIG. 3) may be coupled to the PCB assembly 130. The user interface 112 also may be used to control the light sources 185. The user interface 112 may allow for controlling the light(s) 110 of the housing 102 and the light sources 185 of the cord 170 at the same time or independently, e.g., by initiating one or more operating modes of the lighting device 100.

The opposite, free end of the cord 170 optionally may include an electronic connector 175, which may include any of the features of the electronic connector 118 of the housing 102. For example, the electronic connector 175 may be a USB-type connector or port, such as USB 2.0, USB 3.0, USB-C, or micro-USB, or another type of connector compatible with electronic devices, e.g., Thunderbolt or Lightning. The electronic connector 175 may provide the ability to charge the battery of an external electronic device, e.g., a portable device such as a smartphone or tablet, from the lighting device 100.

The housing 102 may be movable between a first configuration and a second configuration to allow a user to access the cord 170 stored within the housing 102. For example, the lighting device 100 may have a first, closed configuration as illustrated in FIG. 1, and a second, open configuration as illustrated in FIG. 2. In the closed configuration, the components of the housing 102 (first section 106, second section 108, and third section 104) are coupled together so as to enclose the cord 170 within the housing 102. Each of the first section 106, the second section 108, and the third section 104 may be separate components with complementary mating elements, such as clips, threads, screws, magnets, friction fit, etc. In some examples, the third section 104 may be integral with, or fixedly attached to, either the first section 106 or the second section 108. For example, for moving between the first and second configurations of the lighting device 100, the first and third sections 106, 104 of the housing 102 may move as a unit towards and away from the second section 108 (see FIG. 2), or the second and third sections 108, 104 may move as a unit towards and away from the first section 106. A seal 113 may be used between any two sections secured together. For example, a seal 113 is shown in the exploded view of FIG. 3 between the first section 106 and the third section 104. The seal 113 may comprise rubber or other polymer, or an adhesive.

Figure 5:
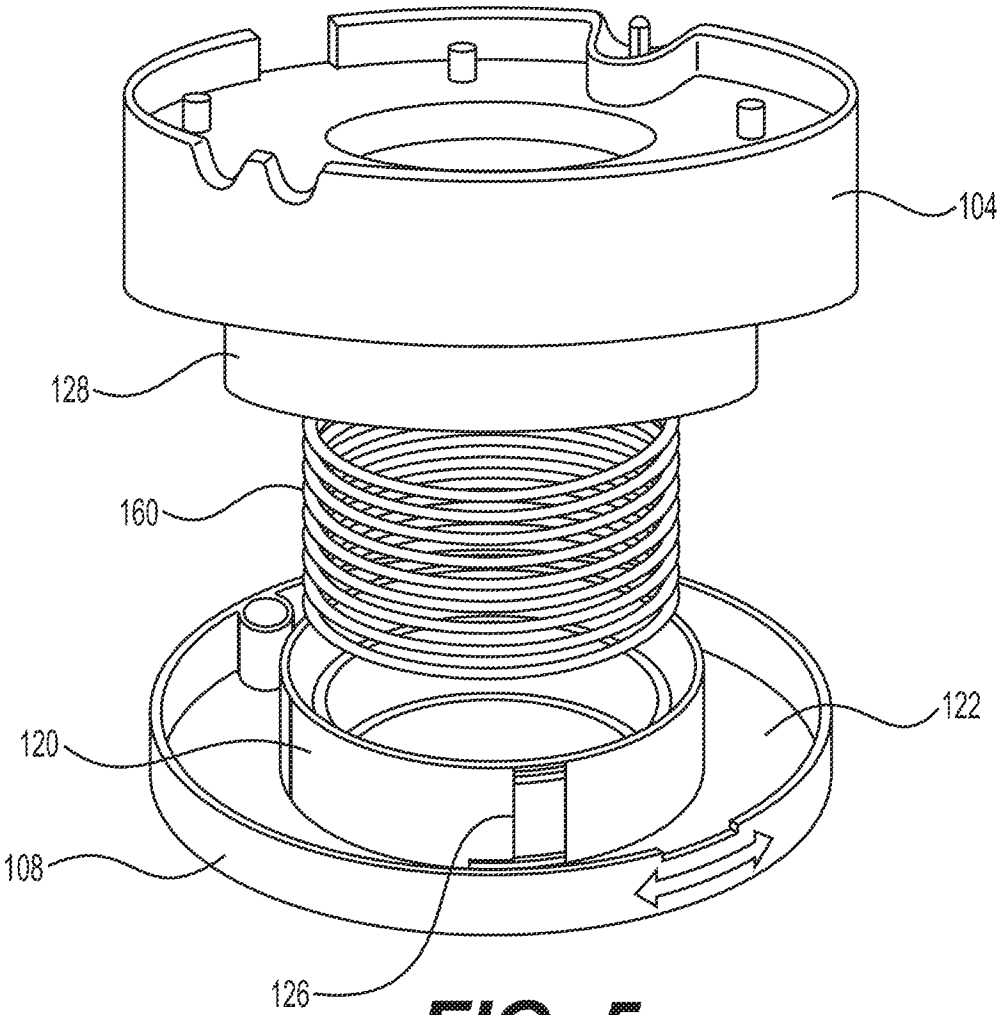
FIG. 5 shows an exploded view of a portion of the device of FIG. 1.

The housing 102 may define a space for storing the cord 170. That is, a user may place the cord 170 within the housing 102 to facilitate storing the lighting device 100 when not in use. As shown in FIG. 5, the second section 108 of the housing 102 may include a groove 122 between inner and outer walls of the second section 108, wherein the inner wall is defined by a cylindrical structure 120. The dimensions of the groove 122 (i.e., the space between the inner and outer walls of the second section 108) may provide sufficient volume for the cord 170 to be wrapped around the cylindrical structure 120, such that the cord 170 may be fully contained within the housing 102 in the closed configuration of the lighting device (as shown in FIG. 1).

The cord 170 may be manually wrapped around the cylindrical structure 120 and/or a motor may be used to automatically retract and/or advance the cord 170. For example, the housing 102 may contain a motor coupled to a proximal portion of the cord 170, such that, as the motor turns, the proximal portion of the cord 170 rotates so as to cause the cord 170 to wrap (and/or unwrap) around the cylindrical structure 120 automatically. In such cases, the lighting device may include an actuator to initiate and terminate the motor.

As illustrated in FIGS. 3 and 5, the lighting device 100 may include a spring mechanism for opening and closing the housing 102 in order to access and store the cord 170, respectively. This is exemplary only, as other mechanisms may be used to move between the first, closed configuration and second, open configuration of the housing 102. For example, complementary mating elements such as, e.g., pairs of magnets, threads, clips, or latches may be used to secure and release two sections of the housing. In such cases, the spring 160 may be omitted.

The cylindrical structure 120 of the second section 108 of the housing 230 includes one or more slots 126. The third section 104 of the housing 102 includes a cylindrical structure 128 having a projection corresponding to each slot 126. For example, the lighting device 100 may include two projections for two slots 126, three projections for three slots 126, four projections for four slots 126, etc. A spring 160 biases the second and third sections 108, 104 apart. Pressing the third section 104 towards the second section 106 (compressing the spring 160) while rotating the third section 104 relative to the second section 108 allows the projections to engage with the slots 126. For example, each slot 126 may be L-shaped having a horizontal leg and a vertical leg, such that pressing the housing sections 104, 108 together engages each projection first with the vertical leg of each slot 126. Then, rotating the third section 104 relative to the second section 108 moves each projection along the horizontal leg of each slot 126 to lock the housing 102 in the closed configuration. Rotating the third section 104 relative to the second section 108 in the opposite direction disengages the projections from the slots 126. Due to the tension of the spring 160, the third section 104 moves away from the second section 108, such that the housing 102 is in the open configuration.

According to some examples, the lighting device 100 may include one or more pairs of magnets 150, e.g., to assist in moving the housing 102 between the first configuration and the second configuration. When the housing 102 is in the first (closed) configuration, pairs of magnets 150 may be aligned and attracted together so as to help secure the housing sections together. Rotating the third section 104 relative to the second section 108 may cause the pair(s) of magnets 150 to rotate out of alignment.

As mentioned above, user input may be used to initiate and transition between various operating modes of the lighting device 100. For example, selections inputted via the user interface 112 may control the LED(s) 110 of the housing 102, the LED(s) 185 of the cord 170 and/or other functions of the lighting device 100. A microprocessor of the PCB assembly 130 operably coupled to the user interface 112 may be configured to control the LEDs and/or other electronic components of the lighting device. Any of the operating modes of U.S. Pat. No. 9,080,736, incorporated by reference herein, may be used in the present disclosure.

For example, a first section via the user interface 112 (e.g., pressing a button or actuating a switch) may initiate a first operating mode, a second selection may initiate a second operating mode, and an nth selection may initiate an nth operating mode. Additionally or alternatively, a transceiver may receive data wirelessly, e.g., from the Internet and/or via Bluetooth technology, and transmit the data to a microprocessor of the PCB assembly 130 for initiating different operating modes of the lighting device 100. The lighting device 100 may be provided with hardware and/or processing devices for implementing Z-wave, X-10, Insteon, Zigbee, C-Bus, EnOcean, KNX, and/or UPB home automation standards, e.g., for control using a smartphone, television, touchscreen, voice control, or any other desired user interface, such as part of a home automation or other internet of things (IOT) system.

With respect to controlling the LEDs, each operating mode may include different intensity settings (e.g., off/on, low brightness, medium brightness, high brightness), different color settings (e.g., changing or cycling between different colors of light), timed on/off sequences, and the like. For example, the LEDs may be operated a different levels of intensity, such as low (such as about 20-40 lumens, e.g., 15 lumens), medium (such as about 50-75 lumens, e.g., 55 lumens), high (such as about 75-150 lumens, e.g., 100 or more lumens).

For example, a first operating mode may include illuminating the base light 110, without illuminating the LEDs 185 of the cord 170. A second operating mode may include illuminating the LEDs 185 at a low intensity setting (with or without illuminating the base light 110), a third operating mode may include increasing the intensity of the LEDs 185 to a medium setting, and a fourth operating mode may include increasing the intensity of the LEDs 185 to a high setting. Additional or alternative operating modes may result in blinking or flickering of the LEDs 185, among other on/off sequences or patterns of the LEDs 185. In some examples, the lighting device 100 may be configured to cycle through two or more different operating modes.

The operating modes, e.g., algorithms or protocols, may be stored on the PCB assembly 130. For example, a microprocessor of the PCB assembly 130 may be configured to control at least one operating mode or a plurality of operating modes, e.g., 2, 3, 4, 5, or 6 or more different operating modes. Additionally or alternatively, instructions for one or more operating modes may be stored on other electronic components, such as a control circuit contained within one or more nodes 180 of the cord 170, or as part of a sensor or other electronic component(s) of the lighting device 100, such as a speaker (see FIG. 9). Data may be relayed between electronic components to execute instructions according to each operating mode. In some embodiments, the lighting device 100 may be configured to generate sound, e.g., wherein the lighting device includes a speaker (see FIG. 9). In such cases, the lighting device 100 may include one or more operating modes for generating sounds, optionally in combination with controlling LEDs.

FIGS. 7A and 7B illustrate additional configurations of cords and corresponding light sources that may be used with any of the devices herein. FIG. 7A shows lighting device 200 and FIG. 7B shows lighting device 300, either of which may include any of the features of the lighting device 100 discussed above.

Referring to FIG. 7A, for example, the lighting device 200 includes a housing 202 that includes a first section 204 coupled to a second section 208 via cylindrical structure 220. The first section 202 includes a solar panel 205, e.g., similar to solar panel 105 of lighting device 100. The lighting device 200 also includes a cord 270 with a plurality of light sources, e.g., LEDs 285, arranged along the length of the cord 270. In this example, the cord 270 includes a plurality of extensions 282 disposed at regular intervals, each extension 282 including three LEDs 285. The extensions 282 may comprise a flexible or semi-rigid material to facilitate storage when the cord 270 is contained within the housing 202. Exemplary materials suitable for the extensions 282 include, for example, flexible polymers, and natural and synthetic fabrics and fiber materials. The LEDs 285 may be coupled to one or more surfaces of each extension 282 and/or integrated into the material(s) of the extension 282. For example, the extensions 282 may comprise a transparent or translucent material, allowing LEDs embedded within the material to emit light therethrough.

In some examples, the extensions 282 may be configured to pivot such that the extensions 282 are transverse to the cord 270 in use (as illustrated in FIG. 7A) but may be rotated to be parallel to the cord 270 for storage. Each extension 282 may include any number of LEDs, e.g., 1, 2, 3 (as shown), 4, or 5 or more LEDs. Similarly, the cord 270 may include any number of extensions 282. For example, the number and placement of extensions 282 may correspond to the number and placement of nodes 80, 180 discussed above in connection to FIGS. 1 and 6. Further, the cord 270 may include any of the features of cords 70 and/or 170. As illustrated, for example, the cord 270 includes an electronic connector 275, e.g., a USB-type connector.

The lighting device 300 of FIG. 7B may include any of the features of lighting device 100. For example, the lighting device 300 includes a housing 302 that includes a first section 304 coupled to a second section 308 via cylindrical structure 320. The first section 302 includes a solar panel 305, e.g., similar to solar panel 105 of lighting device 100. The lighting device 300 also includes a cord 370 with a plurality of nodes 380 each containing one or more light sources, e.g., LEDs 385. In this example, the cord 370 also includes a coupler 375 that attaches to a second cord. That is, the free end of the cord 370 includes an attachment 375*a* complementary to the attachment 375*b* of a free end of another cord (which may be substantially the same as cord 370 or may have a different arrangement of light sources). In this way, the length of the cord 370 can be extended by attaching multiple cords together. The coupler may employ any suitable attachment mechanisms, such as clips, latches, male/female connections, etc., in order to provide electronic contact for powering the LEDs 385 of each cord 370.

FIGS. 8A-8C illustrate additional configurations of support members that may be used with any of the devices herein. FIG. 8A shows lighting device 310, FIG. 8B shows lighting device 320, and FIG. 8C shows lighting device 330, any of which may include any of the features of the lighting devices 100, 200, 300 discussed above. Support members such as handle 115 of lighting device 100 may be used for positioning the respective devices in a number of different configurations and/or for displaying the respective devices.

For example, FIGS. 8A and 8B show different types of handles useful for carrying and/or hanging the respective devices. The lighting device 310 of FIG. 8A includes a housing that includes a first section 314 coupled to a second section 318, the first section also having a handle 315 attached thereto. The two ends of the handle 315 may be attached to the housing at pivot points 317, allowing the handle 315 to rotate relative to the housing. The handle 315 may be flexible or rigid, and may include any of the materials of handle 115 discussed above. While the handle 315 is illustrated as being coupled to the first section 314 of the housing, in other examples, the handle 315 may be coupled to the second section 318 and/or different surfaces of the housing than those expressly shown in FIG. 8A.

The lighting device 320 of FIG. 8B includes a housing that includes a first section 324 coupled to a second section 328, the first section also having a handle 325 attached thereto. In this example, the two ends of the handle 325 are coupled together and fixed to the housing, e.g., at first section 324. The handle 325 forms a loop (similar to handle 115 above) that may be useful for handing the lighting device 320 from different structures, e.g., a hook. The handle 325 may be flexible or rigid, and may include any of the materials of handle 115 discussed above. While the handle 325 is illustrated as being coupled to the first section 324 of the housing, in other examples, the handle 325 may be coupled to the second section 328 and/or different surfaces of the housing than those expressly shown in FIG. 8B.

FIG. 8C illustrates another type of handle 335 that may be used to hang the lighting device 330 and/or may be used for support, in the manner of an easel or kickstand. The lighting device comprises a housing that includes a first section 334 and a second section 338, e.g., wherein the first section 314 may include a solar panel similar to solar panel 105 of lighting device 100. In this example, the handle 335 may be rigid in order to support the housing of the lighting device 330, e.g., such that the lighting device 330 is able to stand on a surface such as a table top, the ground or floor of a building, etc. The two ends of the handle 335 may be attached to the housing at pivot points 337, allowing the handle 335 to rotate relative to the housing. As shown, the handle is coupled to a second section 338 of the housing. In this way, the surface of the first section 334 of the housing that includes a solar panel may face outward, e.g., towards the sun, for recharging.

Figure 9:
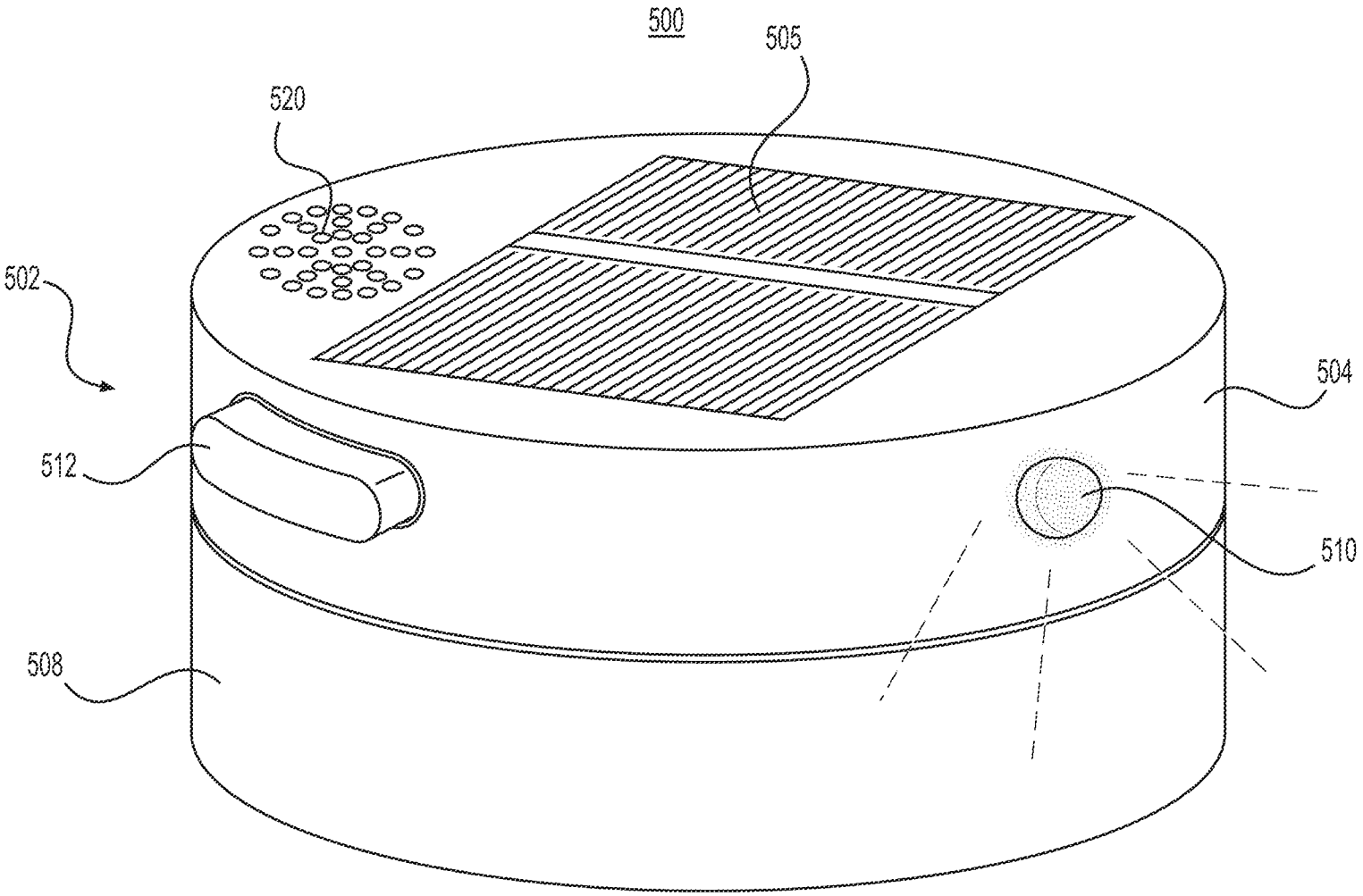
FIG. 9 shows an exemplary device with an acoustic component, in accordance with some aspects of the present disclosure.

As mentioned above, the lighting devices herein may be configured to generate sound. For example, FIG. 9 illustrates an exemplary lighting device 500 that includes a speaker 520. Additionally or alternatively, the lighting device 500 may include an audio output for connection to an external speaker or audio-generating or audio-amplifying device. The lighting device 500 includes a housing 502 with a first section 504 and a second section 508, the first section 504 including a solar panel 505. The lighting device 500 is also illustrated with a base light 510 facing outward from the housing, e.g., from a side wall of the first section 504. The lighting device 500 includes a user interface 512 for controlling the base light 510 and/or one or more operating modes of the lighting device 500, including controlling the speaker 520 and/or other LEDs. The lighting device 500 may include any of the features of lighting devices 100, 200, 300, 310, 320, and/or 330 discussed above.

Exemplary operating modes audio-enable devices such as lighting device 500 may include generating such sounds as white noise, babbling brook, wind, lightning storm, bird sounds, crickets, waterfall, rainfall, crashing waves, and/or other ambient sounds that may be associated with an urban, residential, or rural location. Further, for example, the lighting device 500 may be configured to play music, e.g., via an integrated audio player such as an MP3 player and/or by connecting the lighting device 500 to an audio device. Various operating modes of the lighting device 500 may combine light and sound. For example, the lighting device 500 may be configured to modify light output from base light 510 (and/or LEDs of a cord coupled to the housing 502, such as LEDs 185 of cord 170), according to the sound and/or rhythm of music generated and/or detected by the lighting device 500.

Figure 10:
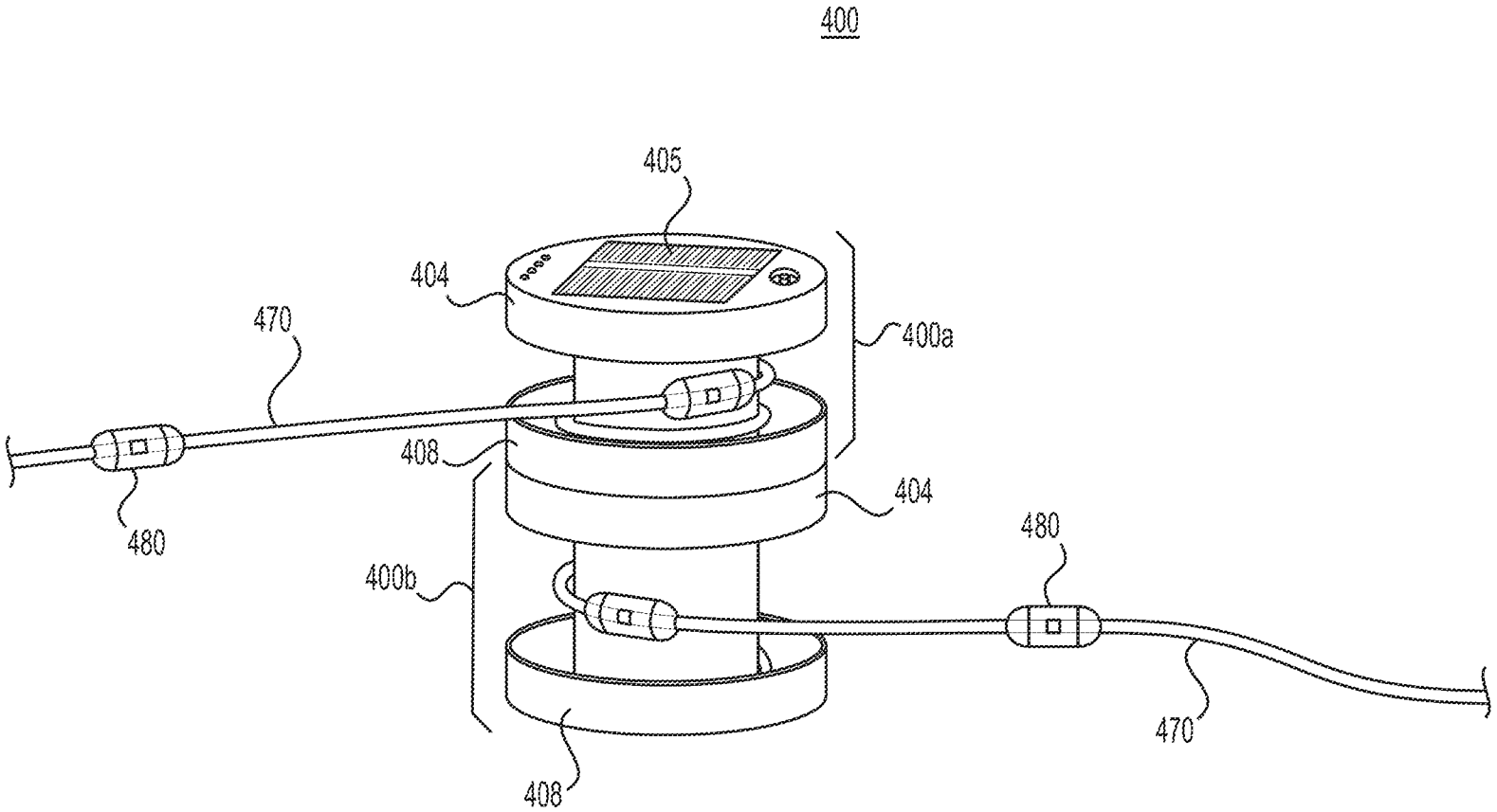
FIG. 10 shows an exemplary modular configuration of devices in accordance with some aspects of the present disclosure.

The lighting devices herein may be configured to be coupled together in use, e.g., in a modular fashion. FIG. 10 illustrates an exemplary modular device 400 assembled from two lighting devices 400*a*, 400*b*, each of which may include any of the features of lighting devices 100, 200, 300, 310, 320, 330, and/or 500 discussed above. For example, each lighting device 400*a*, 400*b* includes a housing with a first section 404 and second section 408, the first section 404 including a solar panel 405. Each lighting device 400*a*, 400*b* further includes a cord 470 with one or more nodes 480 that contain LEDs.

The lighting devices 400*a*, 400*b* may be configured to be stacked upon one another. In some examples, the second section 408 may include a shape and/or mating elements complementary to the shape or mating elements of the first section 404 to facilitate assembling the lighting devices 400*a*, 400*b* together. In some cases, assembling the lighting devices 400*a*, 400*b* together may provide for electronic connection between the two, allowing for the devices 400*a*, 400*b* to be controlled simultaneous via a single user interface of one of the lighting devices 400*a* or 400*b*. for example, user input to the housing of one lighting device 400*a* may cause LEDs of the other lighting device 400*b* to illuminate. In this way, a user may selectively couple together a plurality of lighting devices for integrated control, synchronized powering on, synchronized powering off, synchronized color changes, synchronized flickering, and so on. Additional examples of modular lighting devices are illustrated in FIGS. 12A-12D, discussed below.

Figure 11A:
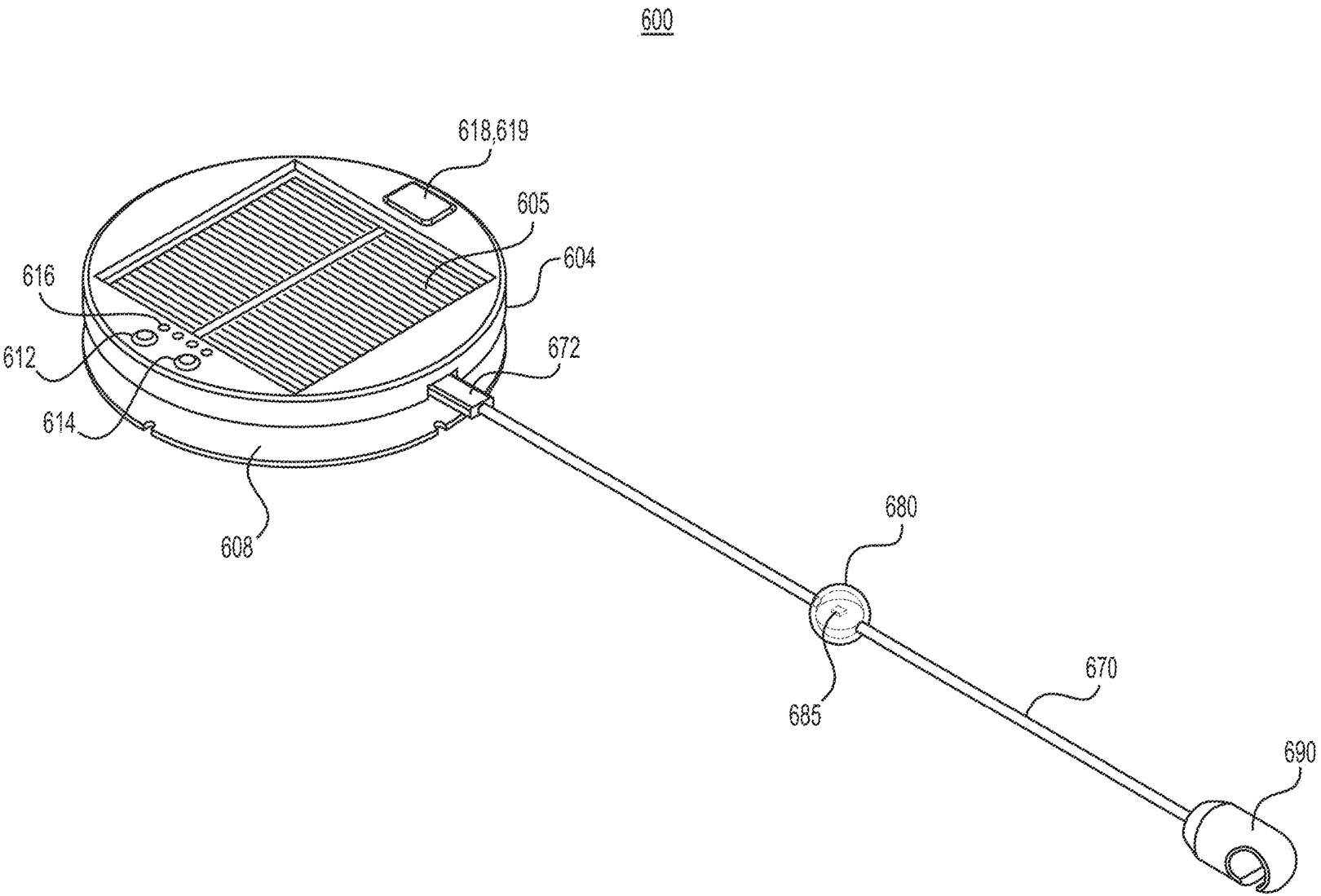
Figure 11B:
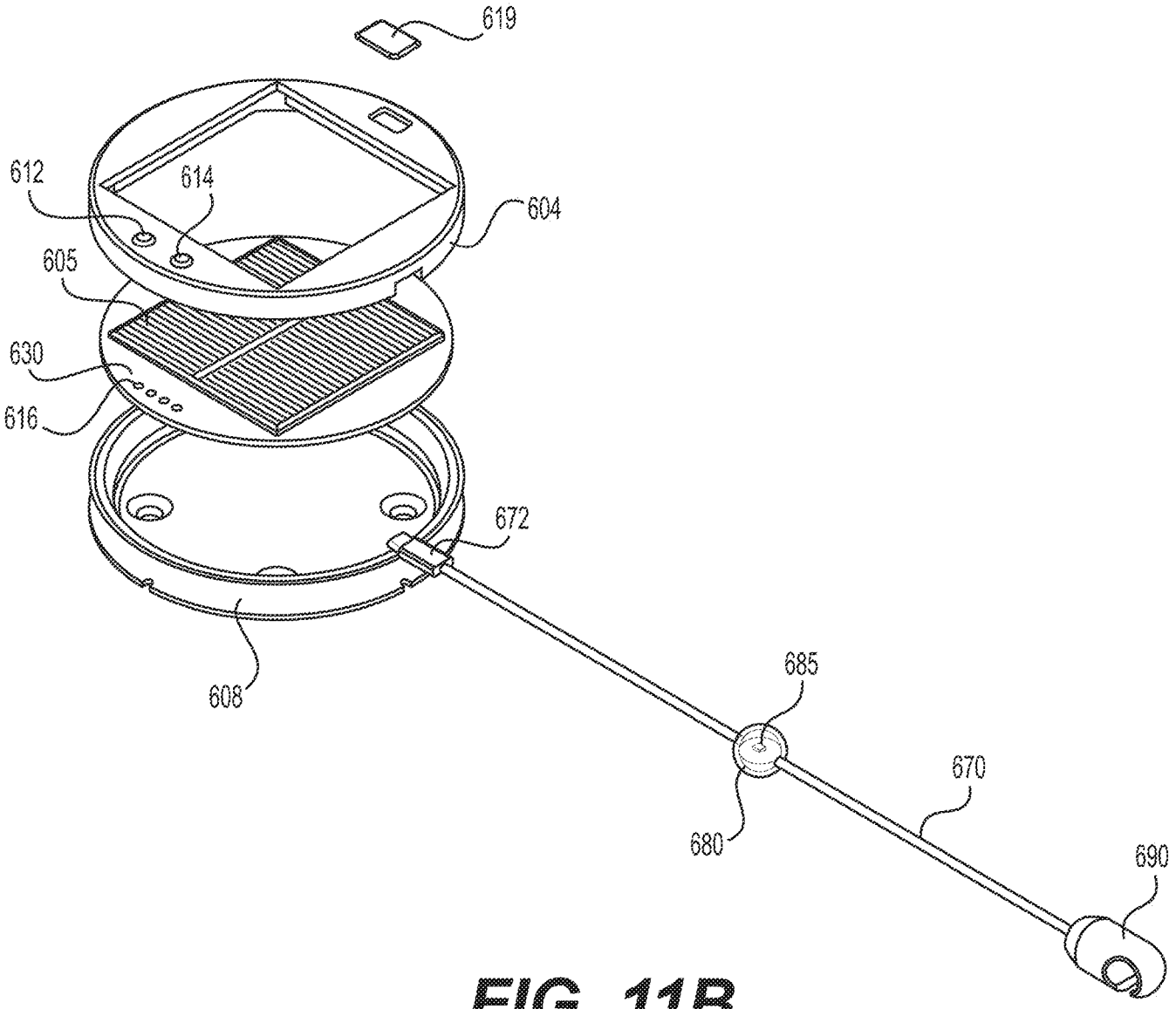
Figure 11C:
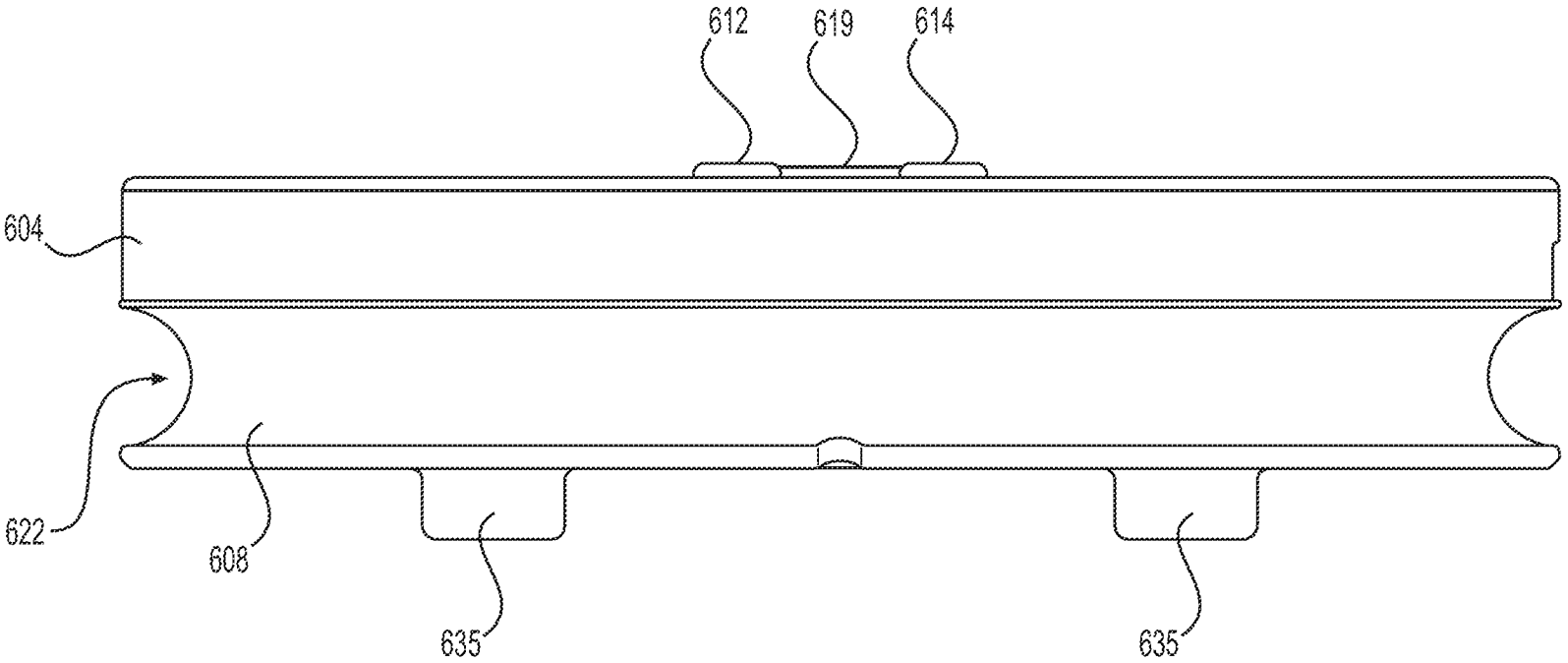

Another exemplary lighting device 600 according to the present disclosure is illustrated in FIGS. 11A-11C. the lighting device 600 may include any of the features of lighting devices 100, 200, 300, 310, 320, 330, 400, and/or 500 discussed above. In this example, the lighting device 600 includes a housing comprising a first section 604 coupled to a second section 608, and a cord 670 coupled to the housing. The first section includes a solar panel 605 (e.g., similar to solar panel 105 of lighting device 100), a user interface 612 (e.g., similar to user interface 112), a battery indicator 614 (e.g., similar to battery indicator 114), and a plurality of indicator lights 616 (e.g., similar to indicator lights 116). The lighting device 600 also includes an electronic connector 618 with cover 619 (e.g., similar to electronic connector 118 and cover 119 of lighting device 100).

The cord 670 is coupled to the housing via an electronic connector 672 (and corresponding electronic connector or port of the housing) to allow a user to selectively attach and detach the cord 670. That is one end of the cord 670 includes the electronic connector 672. In this way, the user may exchange different types and configurations of cords (including, e.g., the types of cords shown in FIGS. 1, 7A, and 7B). The other end of the cord 670 may include a hook 690, clip, or other type of element to allow for attaching or hanging the lighting device 600 to a structure. In other examples, the other end of the cord 670 may include an electronic connector (e.g., similar to electronic connector 175 shown in FIG. 1) or an attachment for coupling two cords together (e.g., similar to attachment 375*a* shown in FIG. 7B). the cord 670 also includes at least one node 680 containing one or more light sources, such as LED(s) 685. As discussed in connection to FIG. 6, each node 680 may contain two or more LEDs 685 facing in different directions, e.g., two LEDs 180 degrees apart, three LEDs 120 degrees apart, four LEDs 90 degrees apart, etc.

FIG. 11B shows an exploded view of the lighting device 600, showing a PCB assembly 630 to which the solar panel 605 is mounted, similar to the PCB assembly 130 of lighting device 100. The lighting device 600 may include one or more rechargeable batteries mounted a surface of the PCB assembly 130 or otherwise operably coupled to the PCB assembly 630. FIG. 11C shows a side view of the lighting device 600, showing that the second section 608 of the housing defines a circumferential groove 622 around which the cord 670 may be wrapped, e.g., for storage. The second section 608 also includes two or more feet 635 on which the lighting device 600 may stand.

Figure 12A:
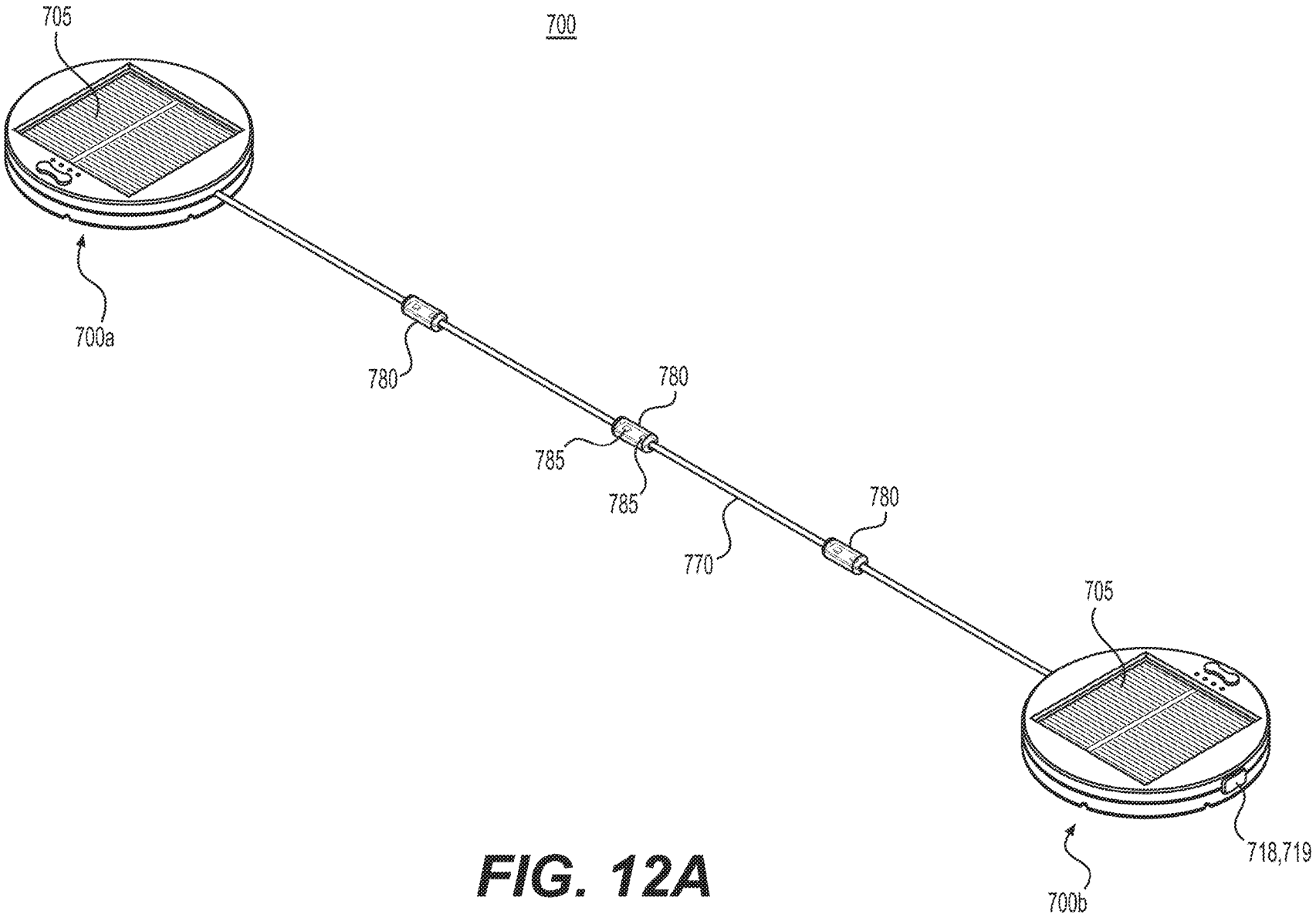
Figure 12B:
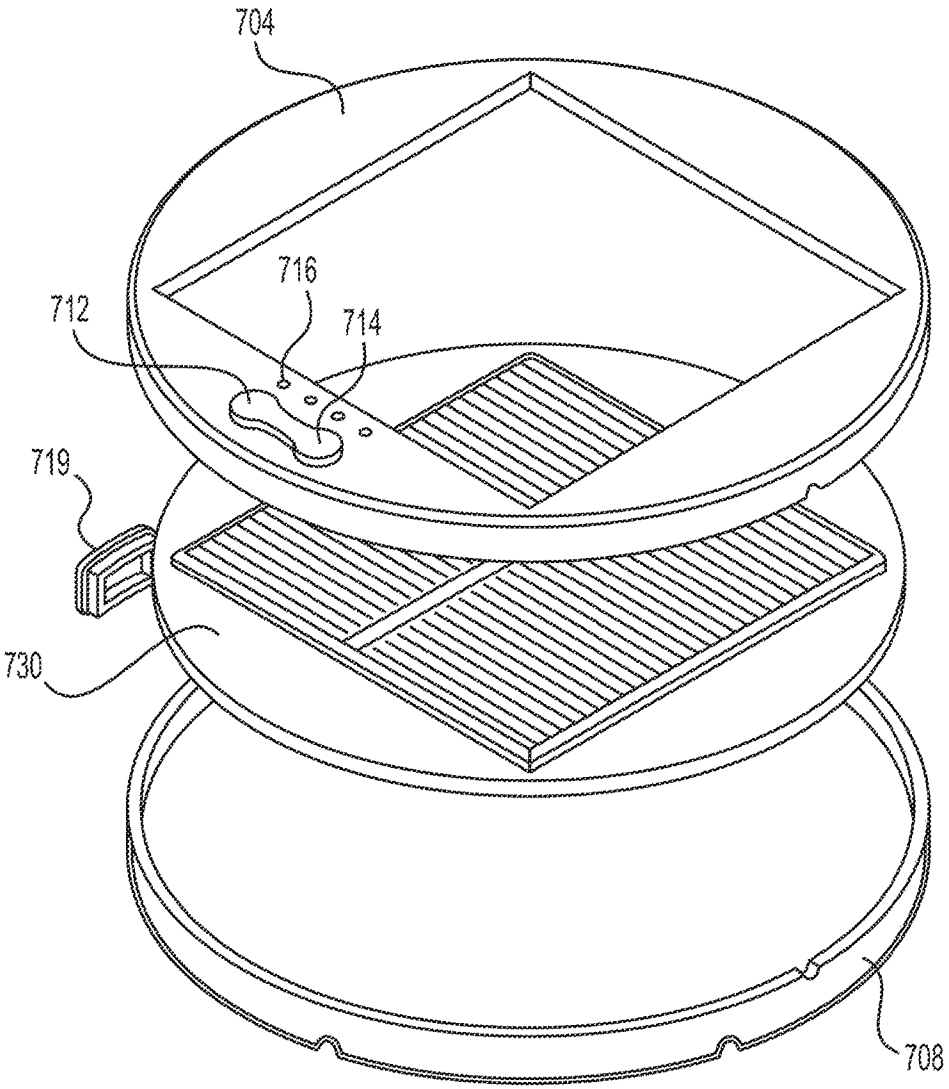

FIGS. 12A-12D illustrate another modular device 700 according to some aspects of the present disclosure, assembled from two lighting devices 700*a*, 700*b*. An exploded view of the components of each lighting device 700*a*, 700*b* is shown in FIG. 12B, including a housing that includes a first section 704 and a second section 708, a PCB assembly 730 to which a solar panel 705 is mounted, a user interface 712, a battery indicator 714, and a plurality of indicator lights 716. Each device also includes one or more electronic connectors 718 and corresponding cover 719. As shown in FIG. 12A, the lighting devices 700*a*, 700*b* are coupled together via a single cord 770 that includes a plurality of nodes 780 with light sources, e.g., LEDs 785. In some examples, at least one end of the cord 770 may be fixedly attached to one of the lighting devices, the cord 770 being fixedly attached to lighting device 700*a* in FIG. 12A. The other end of the cord 770 may include an electronic connector, e.g., similar to electronic connector 175 of lighting device 100, or electronic connector 672 of lighting device 600. In other examples, both ends of the cord 770 may include an electronic connector so as to be attachable and detachable from both lighting devices 700*a*, 700*b*.

Figure 12C:
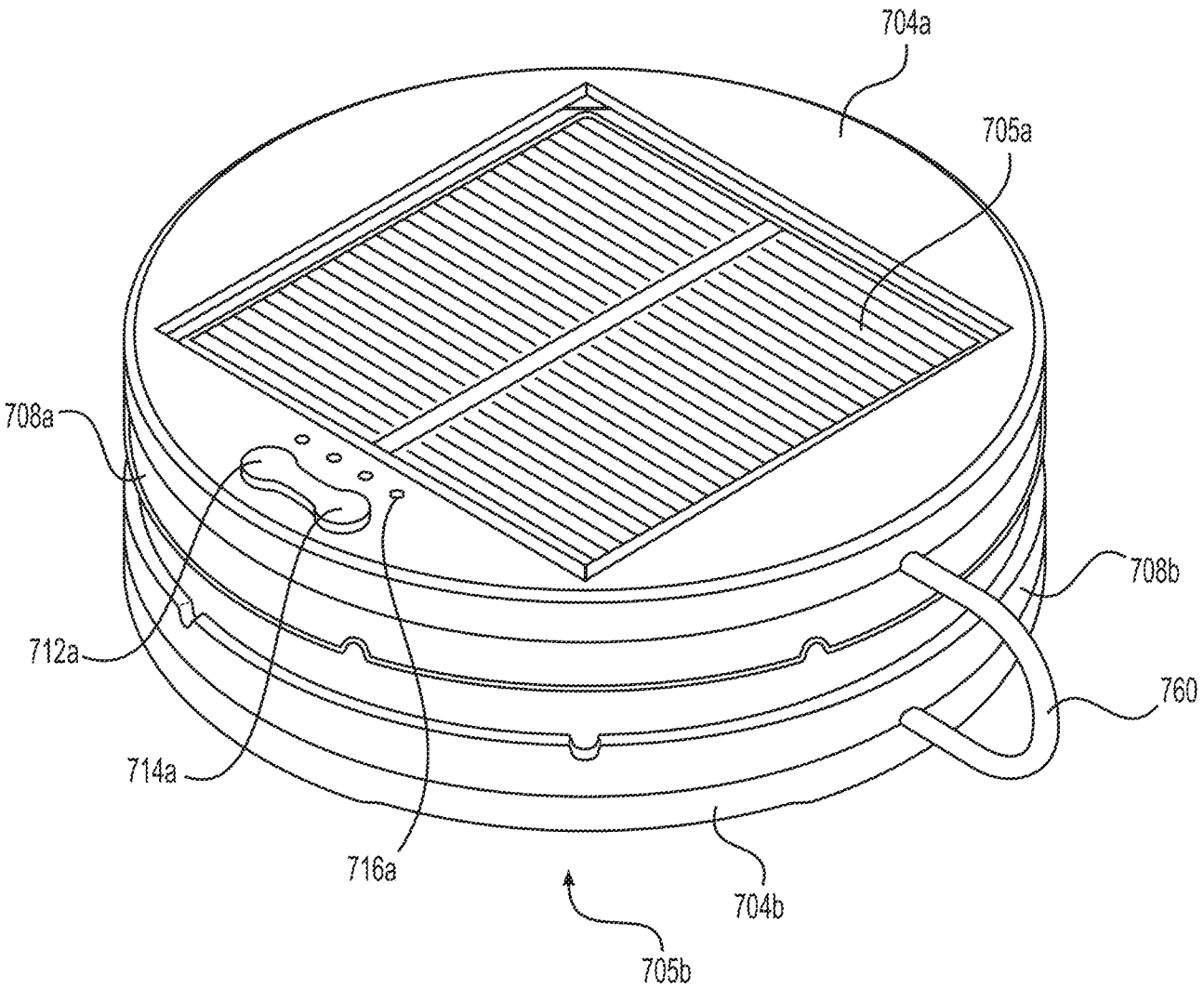
Figure 12D:
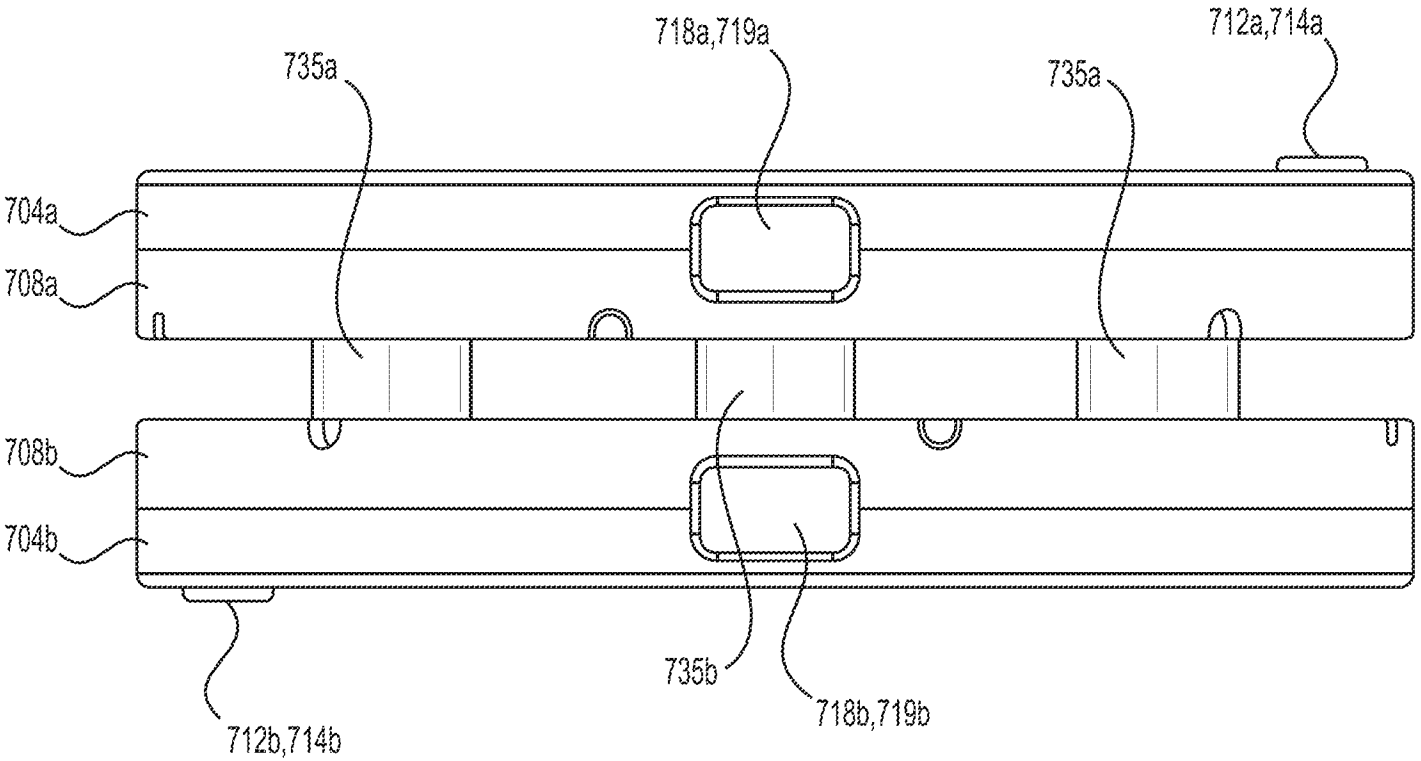

FIGS. 12C and 12D show the lighting devices 700*a*, 700*b* coupled together in a stacked configuration, wherein FIG. 12C shows a perspective view and FIG. 12D shows a side view. In this configuration, the first section 704 of each lighting device 700*a*, 700*b* (i.e., first sections 704*a*, 704*b*, respectively) faces outward and the second sections 708 (i.e., second sections 708*a*, 708*b*, respectively) face inward towards each other. As visible in FIG. 12D, the second sections 708*a*, 708*b* include feet 735*a*, 735*b*, respectively, that provide space between the housings. For example, each lighting device 700*a*, 700*b* may include at least one foot 735*a*, 735*b*, or two or more feet 735*a*, 735*b*. In some examples, the second section 708*a*, 708*b* of each lighting device 700*a*, 700*b* also may include features such as indentations complementary to the feet 735*a*, 735*b* of the corresponding lighting device to facilitate stacking.

The lighting devices 700*a*, 700*b* may be coupled together by any suitable mechanism. FIG. 12C shows a linkage 760 attached to a side wall of each lighting device 700*a*, 700*b*. While the linkage 760 is depicted as relatively short in length (with little, if any slack), the linkage 760 may be any desired length. Further, the ends of the linkage 760 may be detachable from one or both respective housings of the lighting devices 700*a*, 700*b*. For example, the linkage 760 may be coupled to the housings via clips, magnets, or other suitable mating elements, that allow a user to attach and detach the linkage 760 as desired.

The stacked configuration of FIGS. 12C and 12D may be useful for storing the modular device 700 and/or for recharging. Because the first sections 704*a*, 704*b* are positioned such that the solar panels 705*a*, 705*b* face outward, the solar panels 705*a*, 705*b* may be more easily exposed to sunlight for recharging. The respective user elements 712*a*, 712*b* and battery indicators 714*a*, 714*b* of each lighting device 700*a*, 700*b* are accessible, as are the electronic connectors 718*a*, 718*b* (with corresponding covers 719*a*, 719*b*).

FIGS. 13A-13D illustrate another exemplary lighting device 800 to illustrate features that may be incorporated into any of the other devices herein. Similarly, lighting device 800 may include any of the feature of lighting devices 100, 200, 300, 310, 320, 330, 40, 500, 600, and/or 700 discussed above.

Figure 13A:
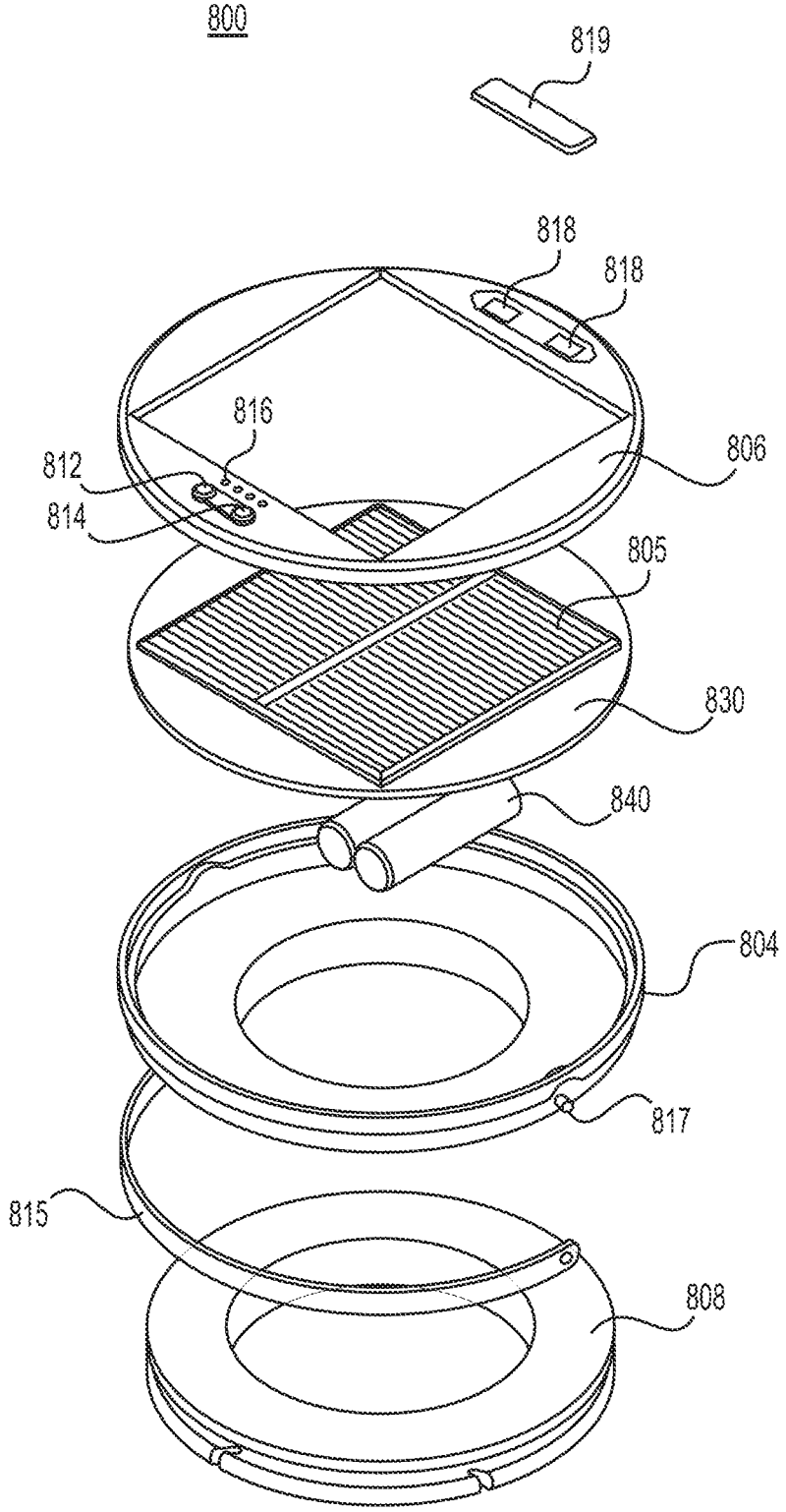

As depicted in the exploded view of FIG. 13A, the lighting device 800 includes a housing having a first section 806, a second section 808, and a third section 804 between the first and second sections 806, 808. The lighting device 800 also includes a PCB assembly 830 with a solar panel 805 mounted thereto, and rechargeable batteries 840 that are received within a corresponding cavity of the third section 804 (which optionally may extend partially into the second section 808; see cavity 842 in FIG. 13D). The first section 806 of the housing includes a user element 812, a battery indicator 814, and indicator lights 816, which may be the same or similar to user element 112, battery indicator 114, and indicator lights 116 of lighting device 100. The lighting device 800 also include a handle 815 coupled to the housing, e.g., third section 804, at pivot points 817 to allow the handle 815 to rotate relative to the housing.

The first section 806 also includes two electronic connectors 818 and a cover 819 with a shape and dimensions suitable for covering both electronic connectors when not in use. Both electronic connectors may be mounted to or otherwise coupled to the PCB assembly 830 to allow for the transfer of power to and/or from other electronic components of the lighting device 800, including rechargeable batteries 840. Thus, as discussed in connection to lighting device 100, the electronic connectors 818 may allow for charging an external electronic device such as a mobile phone or tablet device from power provided by the batteries 840 and/or the batteries 840 may be recharged via the electronic connectors 818 from an external power source.

Figure 13B:
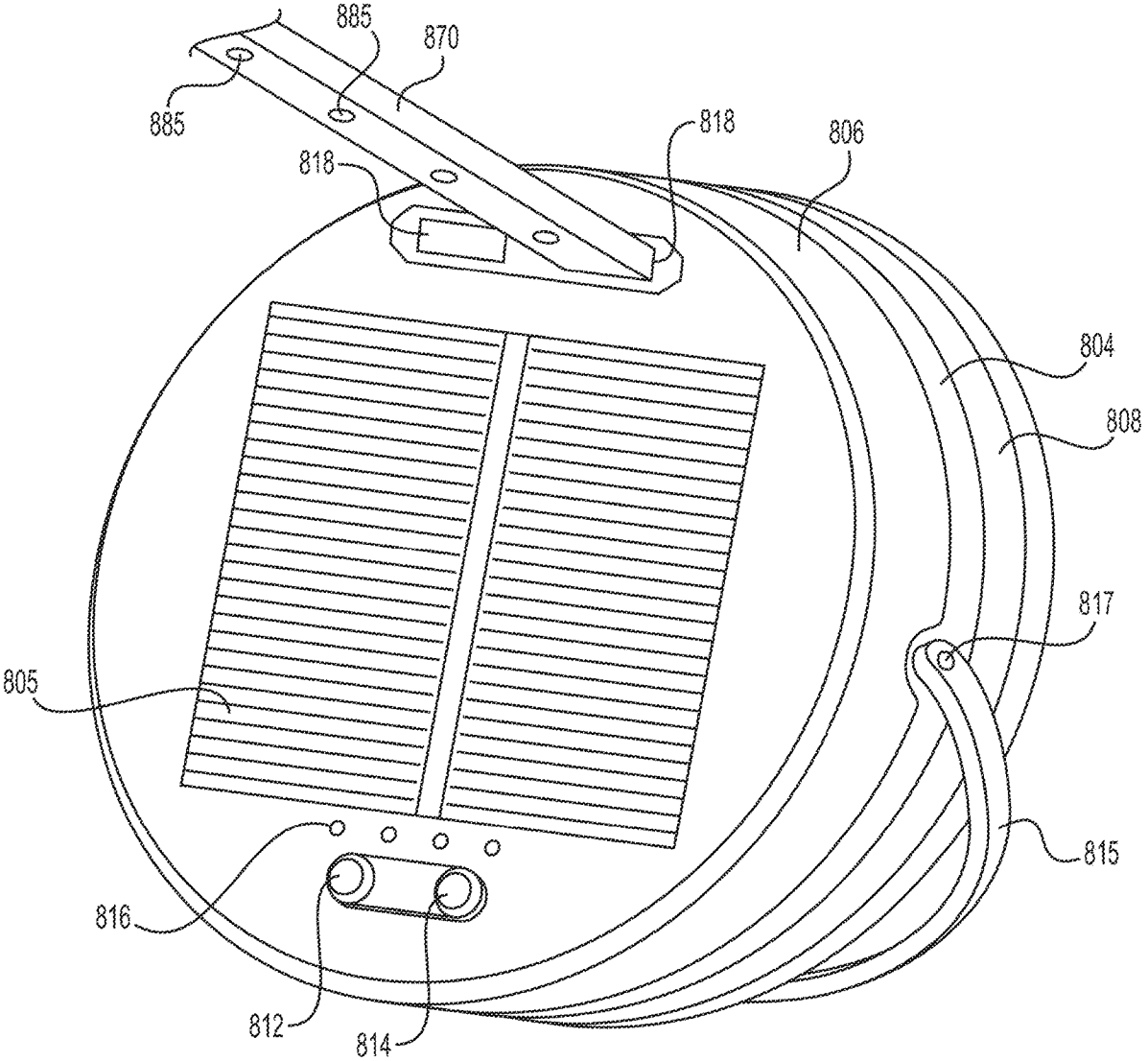
Figure 13C:
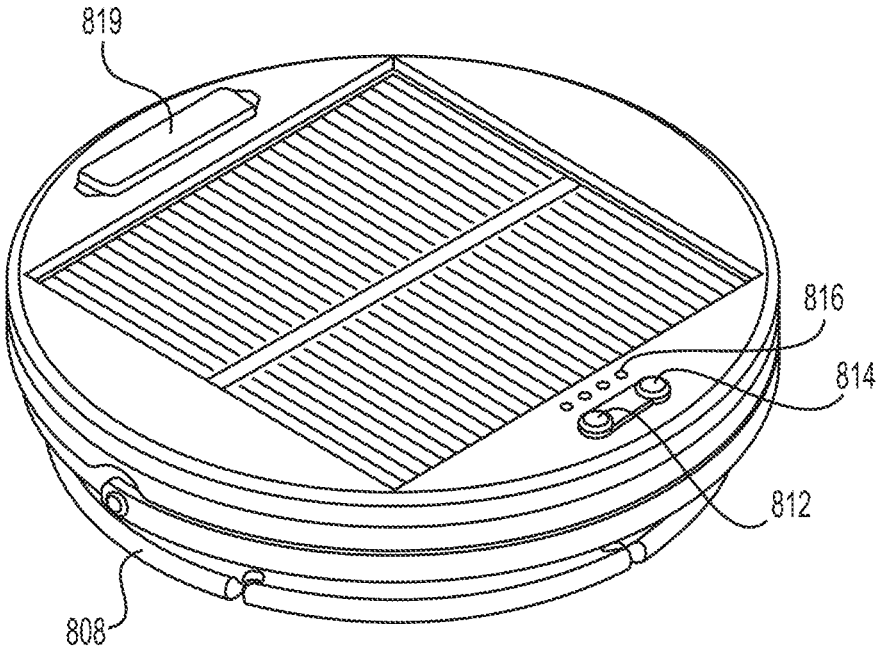
Figure 13D:
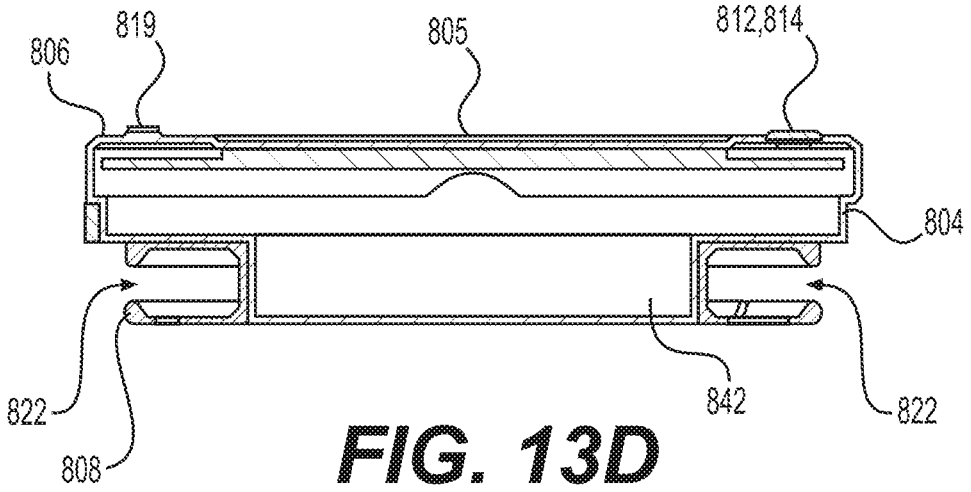

The electronic connectors 818 additionally or alternatively may be used to provide power to a cord 870 with light sources, such as LEDs 885. FIG. 13B shows a cord 870 connected to one of the electronic connectors 818, the cord 870 including a plurality of LEDs 885 disposed along the length of the cord 870 at regular intervals. The cord 870 may be flexible or rigid. In this example, the LEDs 885 are integrated into the material of the cord 870, however, the LEDs 885 may be coupled to the cord 870 via any suitable material or mechanism. Further, LEDs 885 may be positioned along the cord 870 such that they face in different directions, as discussed in connection to cords 70, 170, and 670, for example. As depicted in FIGS. 13C and 13D, the second section 808 of the housing may define a groove 822 along the periphery of the second section 808 sized appropriately for receiving a cord, e.g., cord 870 (assuming the cord 870 is sufficiently flexible to be wrapped around the second section 808 so as to fit within the groove 822).

As mentioned above, the lighting devices herein may be configured to connect to multiple cords. FIGS. 14A-14D illustrate a lighting device 900 coupled to a plurality of cords 970, each cord 970 including one or more nodes 980 with light sources, e.g., LEDs, contained therein. The lighting device 900 may include any of the features of lighting devices 100, 200, 300, 310, 320, 330, 400, 500, 600, 700, and/or 800 discussed above. For example, the lighting device 900 includes a housing 902 that includes a first section 906, second section 908, and third section 904 between the first and second sections 906, 906 (see FIG. 14B). The first section includes a user element 912, a battery indicator 914, indicator lights (not shown), and electronic connector 918 with cover 919, similar to corresponding features of other devices described herein. The lighting device 900 also includes a PCB assembly 930 with solar panel 905 mounted thereto.

The cords 970 are connected to the housing 902 at regularly-spaced intervals, e.g., six cords 970 spaced 60 degrees apart. In other examples, the lighting device 900 may include more or fewer cords 970 spaced at different angles. One end of each cord 970 is attached to the housing 902, e.g., via a permanent or detachable connection, which may be similar to any of the mechanisms by which cords are attached to housings described elsewhere herein. For example, the cords 970 may include electronic connectors received within corresponding electronic connectors (or ports) of the housing, or the cords 970 may be fixedly attached to an interior portion of the housing (e.g., the ends mounted to the PCB assembly 930). The opposite free end of each cord 970 is shown configured as a loop, e.g., to allow for hanging the lighting device 900 to various structures and/or attaching the cords 970 to other structures or devices.

Figure 14D:
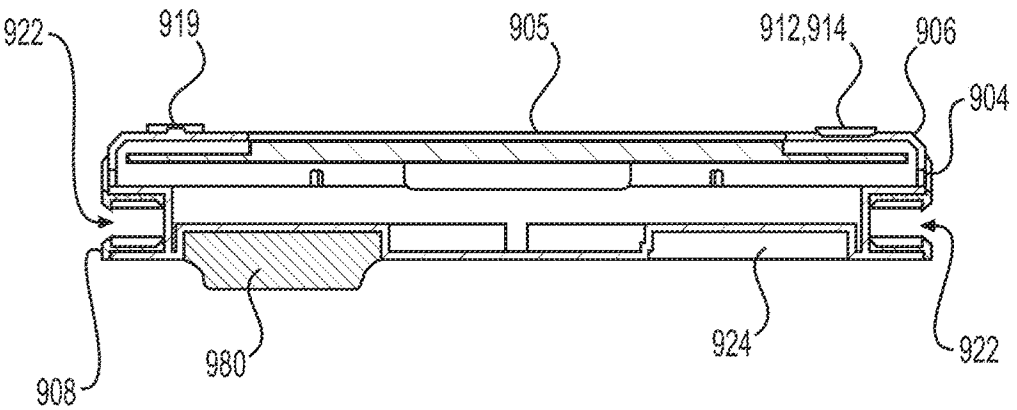
Figure 14C:
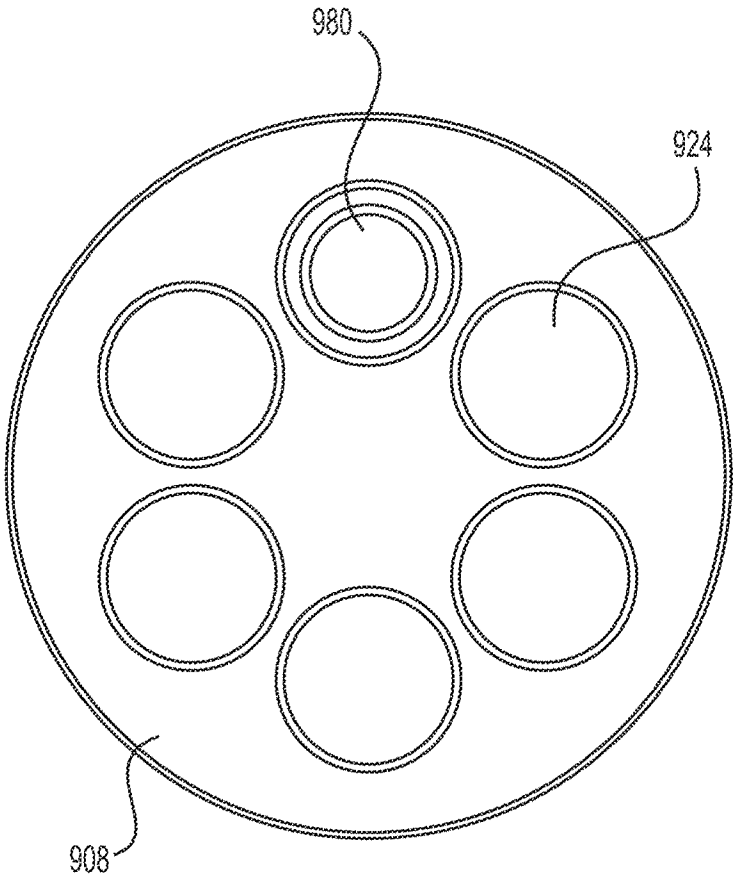

The outward-facing surface of the second section 908 of the housing 902 defines a plurality of sockets 924, each socket having a shape complementary to the shape of the nodes 980 of the cords 970. Thus, each node 980 may be disposed within a corresponding socket 924, e.g., to facilitate storage of the lighting device 900 when not in use. FIG. 14C shows a bottom view of the third section, wherein a node 980 is disposed in a socket 924 and visible from below the lighting device 900. FIG. 14D shows a side view showing one socket 924 that contains a node 980, and one socket 924 that is empty. The third section 908 of the housing also defines a peripheral groove 922 for receiving the cord 970, e.g., during storage of the lighting device 900.

Figure 15A:
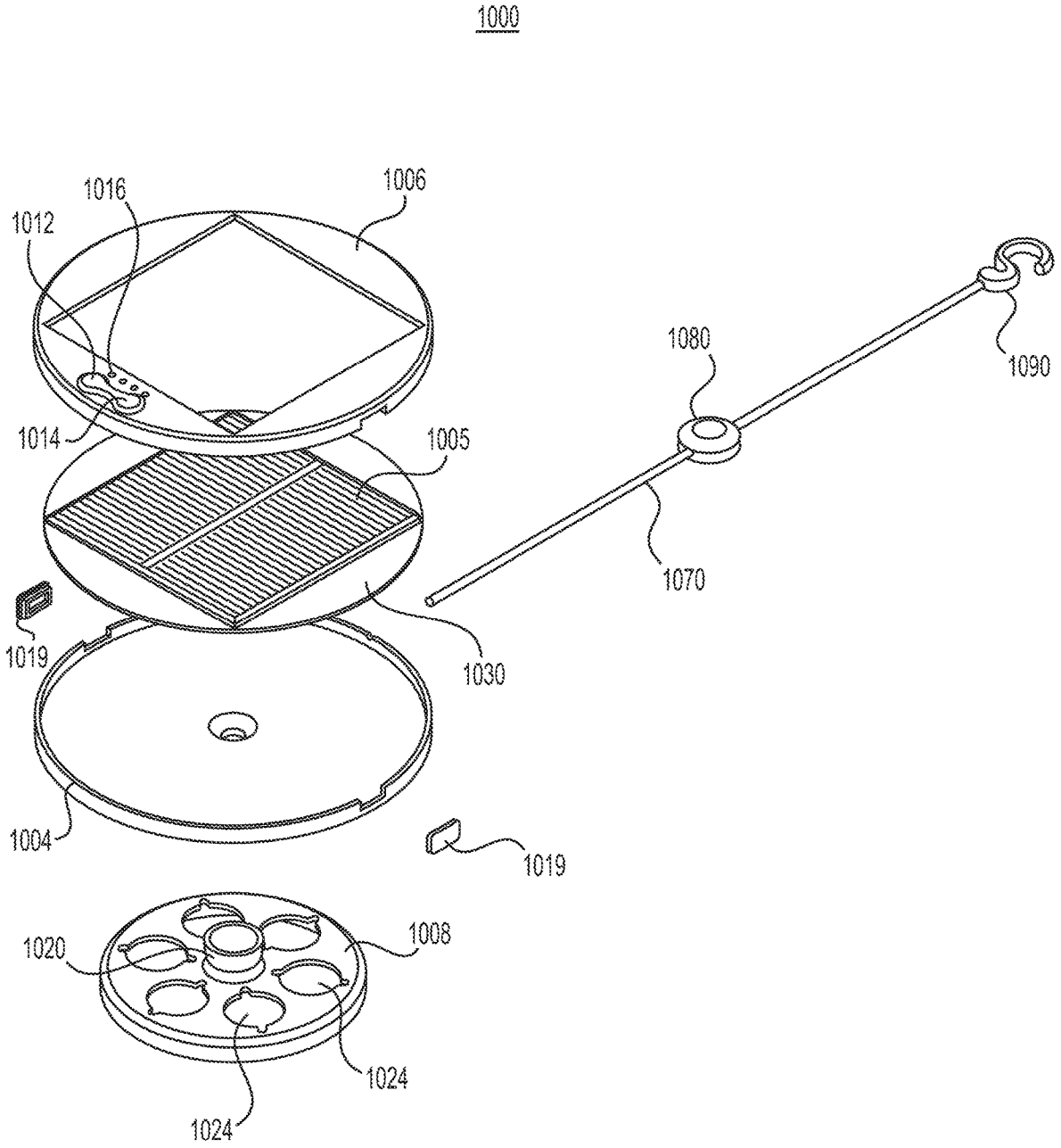
Figure 15B:
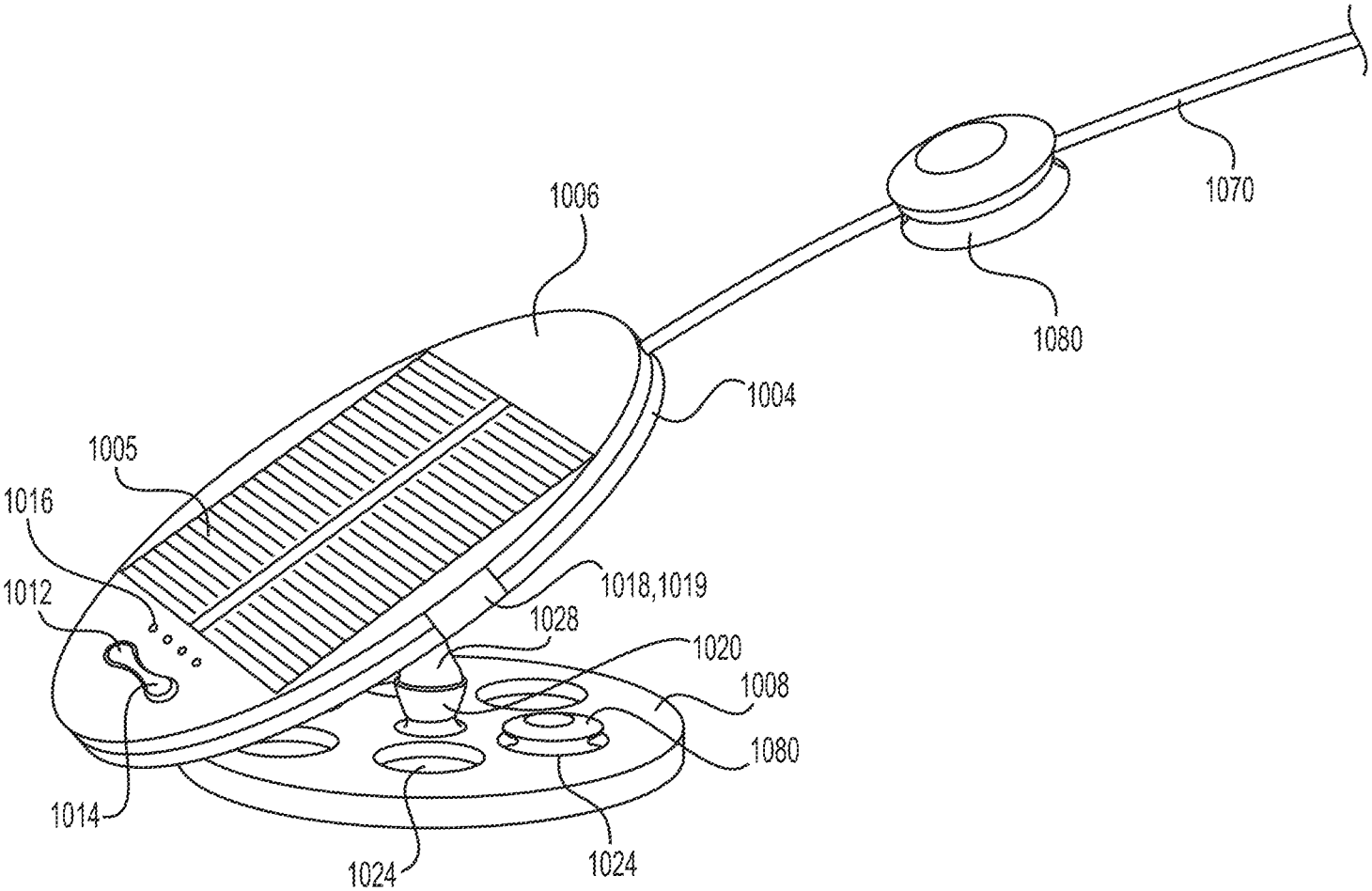
Figure 15D:
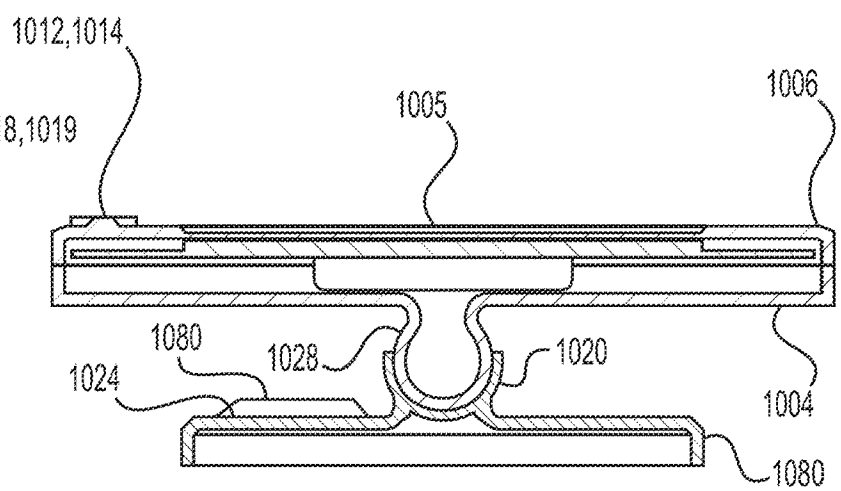

Yet another exemplary lighting device 1000 in accordance with the principles herein is depicted in FIGS. 15A-15D. The lighting device 1000 may include any of the features of lighting devices 100, 200, 300, 310, 320, 330, 400, 500, 600, 700, 800, and/or 900 discussed above. As shown, the lighting device 1000 includes a housing that includes a first section 1006, a second section 1008, and a third section 1004 between the first and second sections 1006, 1008. In this example, the second section 1008 of the housing is spaced apart from the first and third sections 1006, 1004 via a pivot connection as shown in FIGS. 15B and 15D, discussed below.

The lighting device 1000 also includes a PCB assembly 1030 with solar panel 1005 mounted thereto. One or more rechargeable batteries (not shown) may be mounted to the opposite side of the PCB assembly 1030 or otherwise coupled to the solar panel 1005, e.g., the batteries being accommodated in a cavity defined by the second section 1004 of the housing. The first section 1006 includes a user element 1012, a battery indicator 1014, and indicator lights 1016, which may be similar to corresponding features of other devices described herein. The lighting device 1000 further includes at least one electronic connector 1018 and optionally a corresponding cover 1019 (two electronic connectors 1018 and covers 1019 shown in FIG. 15A).

The housing in this example differs from some previous examples herein, in that the first and third sections 1006, 1004 are configured to pivot as a unit relative to the third section 1008. As shown, the lower surface of the third section 1004 includes a projection 1028 having a size and shape complementary to a receptacle 1020 of the third section 1008, such that the projection 1028 is received within, and movable within, the receptacle 1020. The connection between the projection 1028 and the receptacle 1020 may be mechanical, such that a user can rotate the first and third sections 1006, 1004 manually, or the connection may be electronic, such that the user can move the first and third sections 1006, 1004 electronically. For example, in the case of the electronic connection, the user may initiate an operating mode via the user element 1012 to cause the first and third section 1006, 1004 to rotate as a unit relative to the third section 1008. The pivoting motion may allow a user may position the first and third sections 1006, 1004 so that the solar panel 1005 is aimed towards the sun for charging.

Figure 15C:
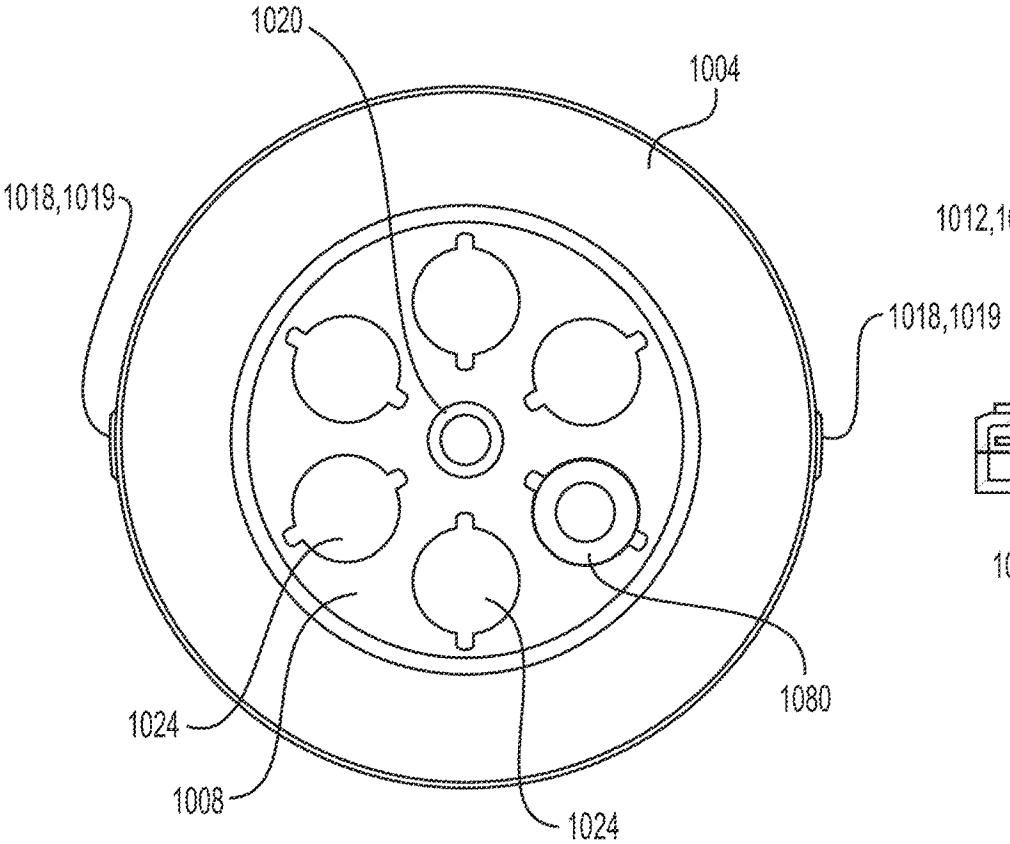

The lighting device 1000 also include a cord 1070, which may include any of the features of the cords described above. As shown in FIG. 15A, the cord 1070 may include at least one node 1080 with one or more light sources, e.g., LEDs, contained within the node 1080. One end of the cord 1070 may be fixedly attached to, or configured to be attached/detached from, the housing. For example, the cord 1080 may be coupled to the first section 1006, the third section 1004, or between the first and third sections 1006, 1004 (as depicted in FIG. 15B). The third section 1008 also defines sockets 1024 for receiving the nodes 1080 of the cord 1070. The sockets 1024 may be configured to receive the nodes 1080 via the upper surface of the third section 1008 (i.e., the surface facing toward the third section 1004), such that the second section 1008 can lie flat against a surface, such as a floor, table top, etc., while the nodes 1080 are disposed therein. The sockets 1024 may be formed as cavities or indentations in the material of the third section 1008, or the sockets 1024 may be apertures or holes extending through the third section 1008. FIG. 15C shows a bottom view of the lighting device 1000 with one node 1080 disposed within a socket 1024, also shown in side view in FIG. 15D.

Any features disclosed herein in connection with one embodiment or example may be combined with any other embodiments or examples. Other embodiments and examples of the present disclosure will be apparent to those skilled in the art from consideration of the specification and practice of the principles disclosed herein. It is intended that the specification and examples be considered as exemplary only, with a true scope and spirit of the disclosure indicated by the following claims.

What is claimed is:

1. A solar powered lighting device comprising:

a housing including a first section, a second section, and a third section, wherein the first section is coupled and movable relative to the second section, the first section including a solar panel coupled to an outer surface of the first section, and the third section defining a side wall between the first and second sections, the housing further comprising:

a rechargeable battery operably coupled to the solar panel;

a microprocessor operably coupled to the rechargeable battery; and a user interface configured to receive user input and transmit the user input to the microprocessor; and an electronic cord enclosed within the housing, and configured to extend outward from the housing when the first section and the second section are moved away from one another, the electronic cord being operably coupled to the rechargeable battery, wherein the electronic cord is flexible and includes at least one light-emitting diode (LED) disposed along a length of the electronic cord;

wherein the microprocessor is configured to control at least one operating mode of the LED of the electronic cord based on the user input.

2. The lighting device of claim 1, wherein the lighting device further comprises at least one LED integrated into the housing and configured to emit light outside the housing.

3. The lighting device of claim 2, wherein the microprocessor is configured control the LED of the housing independent of controlling the LED of the electronic cord.

4. The lighting device of claim 1, wherein the electronic cord comprises a plurality of nodes, each node containing at least one LED.

5. The lighting device of claim 1, wherein the housing defines a groove for receiving the electronic cord in a wrapped configuration when the electronic cord is enclosed within the housing.

6. The lighting device of claim 1, wherein the electronic cord comprises braided wire.

7. The lighting device of claim 1, wherein the electronic cord has a length of at least 6 feet.

8. The lighting device of claim 1, wherein the housing has a first, closed configuration and a second, open configuration, the housing being movable between the first and second configurations by moving the first section relative to the second section.

9. The lighting device of claim 8, wherein the third section is coupled to the first section, the first and third sections being movable relative to the second section.

10. The lighting device of claim 1, wherein the first section of the housing is biased from the second section by a spring.

11. The lighting device of claim 1, wherein the microprocessor is configured to control a plurality of operating modes of the lighting device based on the user input, the plurality of operating modes including at least two operating modes of a plurality of LEDs of the electronic cord.

12. A solar powered lighting device comprising:

a housing including a first section, a second section, and a third section, the first section is coupled and movable relative to the second section, the third section defining a side wall positioned between the first and second sections, the first section including a solar panel coupled to an outer surface of the first section, the housing further comprising:

a rechargeable battery operably coupled to the solar panel;

a microprocessor operably coupled to the rechargeable battery;

a user interface configured to receive user input and transmit the user input to the microprocessor; and a battery indicator operably coupled to the rechargeable battery; and an electronic cord coupled to and disposed within the housing, the electronic cord being operably coupled to the rechargeable battery and configured to extend outwardly from the housing when the first section and the second section are separated from one another, wherein the electronic cord is flexible and includes a plurality of nodes disposed along a length of the electronic cord, each node containing at least one light-emitting diode (LED);

wherein the microprocessor is configured to control at least one operating mode of the LEDs of the electronic cord based on the user input.

13. The lighting device of claim 12, wherein the at least one operating mode of the LEDs includes changing an intensity of the LEDs, a wavelength of the LEDs, or both.

14. The lighting device of claim 12, wherein the at least one operating mode includes at least two operating modes, wherein a first selection of the user interface turns on the LEDs, and second selection of the user interface increases an intensity of the LEDs.

15. The lighting device of claim 12, wherein the LEDs are RGB LEDs, and the at least one operating mode includes changing a color of one or more of the LEDs.

16. A solar powered lighting device comprising:

a housing including a first section, a second section, and a third section, wherein the first section includes a solar panel coupled to an outer surface of the first section, and the first and third sections are movable relative to the second section, the third section forming a side wall between the first section and the second section, the housing further comprising:

a rechargeable battery operably coupled to the solar panel;

at least one LED configured to emit light outside the housing;

a microprocessor operably coupled to the rechargeable battery; and a user interface configured to receive user input and transmit the user input to the microprocessor; and an electronic cord enclosed in the housing and configured to extend outward from the housing when the first and third sections move apart from and relative to the second section, the electronic cord being operably coupled to the rechargeable battery, wherein the electronic cord is flexible and includes a plurality of light-emitting diodes (LEDs) disposed along a length of the electronic cord;

wherein the microprocessor is configured to control at least one operating mode of the LEDs of the electronic cord and at least one operating mode of the LED of the housing based on the user input.

17. The lighting device of claim 16, wherein the electronic cord comprises a plurality of nodes, and each node contains at least two LEDs that face in different directions.

18. The lighting device of claim 16, wherein the housing defines a groove for receiving the electronic cord, the electronic cord having a length of 10 feet to 30 feet.

19. The lighting device of claim 16, wherein the housing has a first, closed configuration wherein the electronic cord is wrapped around a cylindrical structure radially inward of the second section of the housing, and a second, open configuration wherein the electronic cord extends outward from the cylindrical structure and outside the housing, the housing being movable between the first and second configurations by moving the first section relative to the second section.

20. The lighting device of claim 16, wherein an end of the electronic cord includes an electronic connector compatible with an external electronic device.

* * * * *